US010103454B2

(12) United States Patent
Hanazaki

(10) Patent No.: US 10,103,454 B2
(45) Date of Patent: Oct. 16, 2018

(54) STRUCTURE AND METHOD FOR CONNECTING TERMINAL

(71) Applicant: Yazaki Corporation, Minato-ku, Tokyo (JP)

(72) Inventor: Hisashi Hanazaki, Makinohara (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 14/872,777

(22) Filed: Oct. 1, 2015

(65) Prior Publication Data

US 2016/0028167 A1 Jan. 28, 2016

Related U.S. Application Data

(63) Continuation of application No. PCT/JP2014/059368, filed on Mar. 28, 2014.

(30) Foreign Application Priority Data

Apr. 3, 2013 (JP) ..... 2013-077861

(51) Int. Cl.

| | |
|---|---|
| ***H01R 4/10*** | (2006.01) |
| ***H01R 4/18*** | (2006.01) |
| ***H01R 43/048*** | (2006.01) |
| *H01R 13/04* | (2006.01) |

(52) U.S. Cl.

CPC ..... *H01R 4/18* (2013.01); *H01R 4/184* (2013.01); *H01R 43/048* (2013.01); *H01R 13/04* (2013.01)

(58) Field of Classification Search

CPC ..... H01R 4/185; H01R 4/188; H01R 4/183; H01R 4/20; H01R 43/058

USPC ..... 439/877, 878

See application file for complete search history.

(56) References Cited

U.S. PATENT DOCUMENTS

| | | | | |
|---|---|---|---|---|
| 3,590,140 A * | 6/1971 | Robb | ..... | H01R 43/042 174/84 C |
| 5,342,996 A * | 8/1994 | Ito | ..... | H01R 4/184 174/84 C |
| 6,068,505 A * | 5/2000 | Sai | ..... | H01R 4/182 439/422 |

(Continued)

FOREIGN PATENT DOCUMENTS

| | | |
|---|---|---|
| DE | 1515399 A1 | 9/1969 |
| GB | 954618 A | 4/1964 |

(Continued)

OTHER PUBLICATIONS

Sep. 5, 2016—(CN) Notification of the First Office Action—App 201480020264.1.

(Continued)

*Primary Examiner* — Hien Vu

(74) *Attorney, Agent, or Firm* — Banner & Witcoff, Ltd.

(57) ABSTRACT

A terminal has a plurality of clamping portions in which surfaces facing each other serve as clamping surfaces. The plurality of clamping portions are crimped such that the respective clamping surfaces are substantially parallel to each other, thereby clamping strands configuring a fiber conductor, by the clamping surfaces. Each of the plurality of clamping portions is bent at least once in a longitudinal direction of an electric wire so as to maintain a state where the clamping surfaces are substantially parallel to each other.

9 Claims, 22 Drawing Sheets

(56) References Cited

U.S. PATENT DOCUMENTS

| | | | | |
|---|---|---|---|---|
| 6,099,366 | A * | 8/2000 | Shinchi | H01R 4/027 439/594 |
| 6,442,832 | B1 * | 9/2002 | Noble | H01R 43/048 174/261 |
| 6,881,104 | B2 * | 4/2005 | Suzuki | H01R 4/186 439/877 |
| 8,153,899 | B2 | 4/2012 | Mita et al. | |
| 8,776,366 | B2 | 7/2014 | Mita et al. | |
| 9,048,549 | B2 * | 6/2015 | Hanazaki | H01R 4/06 |
| 2009/0315419 | A1 | 12/2009 | Mita et al. | |
| 2010/0092238 | A1 | 4/2010 | Zavattieri et al. | |
| 2012/0159783 | A1 | 6/2012 | Mita et al. | |
| 2013/0175089 | A1 | 7/2013 | Hanazaki | |

FOREIGN PATENT DOCUMENTS

| | | | |
|---|---|---|---|
| JP | 2005-259613 | A | 9/2005 |
| JP | 2009-301839 | A | 12/2009 |
| JP | 2010-003439 | A | 1/2010 |
| JP | 2011-150822 | A | 8/2011 |
| JP | 2011-150841 | A | 8/2011 |
| JP | 2012-074180 | A | 4/2012 |
| JP | 2013-038046 | A | 2/2013 |
| JP | 2013-062123 | A | 4/2013 |
| WO | 2012-039487 | A1 | 3/2012 |
| WO | 2013-021561 | A1 | 2/2013 |

OTHER PUBLICATIONS

Oct. 15, 2015—(WO) English Translation of the International Preliminary Report on Patentability—Intl App PCT/JP2014/059368.

Jun. 3, 2014—International Search Report—Intl App PCT/JP2014/059368.

Aug. 9, 2016—(JP) Notification of Reasons for Refusal—App 2013-077861, Eng Tran.

Mar. 21, 2017—(CN) Office Action—App 201480020264.1.

Dec. 23, 2016 (DE) German Office Action—App 112014001819.8.

Oct. 16, 2017 (CN) Chinese Office Action—App 201480020264.1.

Jun. 13, 2018—(CN) Notification of Reexamination—App 201480020264.1, Eng Tran.

* cited by examiner 32
32a
26
26a
32b
23A
27
11
14
31
31a
25
25a
33
33a
33b

STRUCTURE AND METHOD FOR CONNECTING TERMINAL

CROSS REFERENCE TO RELATED APPLICATIONS

This application is a continuation of International Patent Application PCT/JP14/059368 filed on Mar. 28, 2014, claiming priority from Japanese Patent Application No. 2013-077861 filed on Apr. 3, 2013, the contents of which are incorporated herein by reference.

TECHNICAL FIELD

The present invention relates to a terminal connection structure to an electric wire having a conductor, and a terminal connection method.

BACKGROUND ART

In general, a crimp terminal is crimped and connected to a conductor of an electric wire by disposing the conductor in a barrel and crimping the barrel.

As a connection method of a terminal to an electric wire, a connection method which includes a temporary crimping process of inserting a plurality of enamel-coated conductor wires into a crimp connector in advance and then applying temporary crimping to the crimp connector by mechanical pressurizing means, in which the temporary crimping is to temporarily crimp the crimp connector such that the cross-sectional area of both ends or one end of the cross section orthogonal to an axial direction of the crimp connector is reduced, while suppressing expansion of both ends or one end due to pressurization by an external force, is known (refer to PTL 1).

Further, a technique of suppressing cracking of a terminal during crimping by using a crimp terminal in which a core wire barrel is provided with a substantially rectangular bottom plate having a plate surface parallel to an axial direction of a core wire, and at least two side plates provided to substantially vertically extend upward from both sides of the bottom plate, and the two side plates are arranged in a staggered form along the axial direction of the core wire on both sides of the bottom plate is also known (refer to PTL 2).

On the other hand, in an electric wire which is used in an automobile, due to a rapid increase in in-vehicle wiring place according to an increase or computerization of in-vehicle equipment, a reduction in weight of an in-vehicle electric wire is strongly demanded in order to improve fuel economy, and moreover, an electric wire having flexibility which can be wired in a limited space is required. For this reason, an electric wire having both high conductivity and lightweight properties, or an electric wire provided with a fiber conductor composed of fibers having electric conductivity, such as a carbon fiber, for example, or metal-plated fibers with electric conductivity imparted thereto by performing plating processing on a non-conductive fiber such as an aramid fiber, in order to obtain a cable, is used. The fiber conductor is excellent in a reduction in weight, tensile strength, and bendability, and therefore, the fiber conductor is expected as a conductor of an ultra-fine electric wire (for example, an electric wire having a cross-sectional area of less than or equal to 0.05 (sq)).

CITATION LIST

Patent Literature

[PTL 1] JP-A-2010-3439
[PTL 2] JP-A-2005-259613

SUMMARY OF INVENTION

Technical Problem

However, the fiber conductor has high tensile strength. However, since a fiber which becomes a single strand is very fine, resistance to a shear force is low.

For this reason, as described above, if a barrel of a crimp terminal is crimped and pressed to a fiber conductor, a load intensively acts on the fiber conductor at a serration or the tip of the barrel, and thus the fiber conductor is damaged, whereby there is a concern that a decrease in tensile strength may be caused. Further, the fiber conductor with an external coat removed therefrom is easily separated into pieces, and thus if a gap occurs between electric wires when the crimp terminal is crimped, there is a concern that a conduction property may decrease.

In addition, as described above, in a case where the barrel of the crimp terminal is crimped and pressed to the fiber conductor, the rigidity of a crimping portion by the barrel is lower than the tensile strength of the fiber conductor, and as a result, there is a concern that a decrease in the tensile strength of an electric wire may be caused.

The present invention has been made in view of the above-described circumstances and an object thereof is to provide a terminal connection structure and a terminal connection method in which it is possible to connect a terminal to a conductor while maintaining high tensile strength and bendability.

Solution to Problem

In order to achieve the above-described object, a terminal connection structure according to the present invention is characterized by the following (i) to (iv).

(i) A terminal connection structure in which a metal terminal is connected to an electric wire provided with a conductor composed of a plurality of strands, wherein the terminal has a plurality of clamping portions in which surfaces facing each other serve as clamping surfaces, the plurality of clamping portions are crimped such that the respective clamping surfaces are substantially parallel to each other, thereby clamping the strands configuring the conductor, by the clamping surfaces, and each of the plurality of clamping portions has at least one bent portion in a longitudinal direction of the electric wire and the clamping surfaces are held substantially parallel to each other.

(ii) The terminal connection structure according to the above (i), wherein each of the plurality of clamping portions has two or more of the bent portions in the longitudinal direction of the electric wire and is formed in a crank shape as a whole.

(iii) The terminal connection structure according to the above (i) or (ii), wherein the conductor includes a fiber conductor, and the fiber conductor is composed of strands which are metal-plated fibers with electric conductivity imparted thereto by performing metal plating on a surface of a fiber.

(iv) The terminal connection structure according to the above (iii), wherein the fiber is a polyarylate fiber.

In the terminal connection structure having the configuration of the above (i), the clamping portions are crimped so as to be substantially parallel to each other, and therefore, the strands configuring the conductor are clamped and held in a substantially uniform thickness. In this way, it is possible to provide a connection structure which is excellent in tensile strength and bendability. Further, in the terminal connection structure having the configuration of the above (i), each of the clamping portions is bent in the longitudinal direction of the electric wire, thereby having a bent portion, and therefore, the rigidity of the clamping portion (a crimping portion) pressing the conductor is enhanced. In this way, the rigidity of the clamping portion is prevented from being lower than the tensile strength of the conductor, and thus it is possible to reliably secure tensile strength.

In the terminal connection structure having the configuration of the above (ii), each of the clamping portions is bent twice or more in the longitudinal direction of the electric wire, whereby the entirety is formed in a crank shape, and therefore, the rigidity of the clamping portion as the crimping portion is further enhanced. That is, each of the clamping portions has at least a bent portion which is bent toward the upper side or the lower side on one side in the longitudinal direction of the electric wire and a bent portion which is bent toward the side opposite to the upper side or the lower side on the other side. In this way, it is possible to more reliably secure tensile strength.

In the terminal connection structure having the configuration of the above (iii), the fiber conductor is used, and therefore, while the terminal has more lightweight property, tensile strength of the terminal is not reduced by the fiber whose resistance to a shear force is low being damaged, and the terminal is reliably connected so as to obtain good mechanical and electrical performance.

In the terminal connection structure having the configuration of the above (iv), the polyarylate fiber having high strength and high elastic modulus and being excellent in wear resistance and dimensional stability is used, and therefore, the terminal is more reliably connected so as to obtain good mechanical and electrical performance.

Further, in order to achieve the above-described object, a terminal connection method according to the present invention is characterized by the following (v).

(v) A terminal connection method of connecting a metal terminal to an electric wire provided with a conductor composed of a plurality of strands, including:

a step of disposing the conductor between a plurality of clamping portions provided in the terminal;

a step of gradually bringing the clamping portions close to each other, thereby crimping the clamping portions such that clamping surfaces composed of facing surfaces of the clamping portions are substantially parallel to each other, and thus clamping the conductor in substantially the same thickness; and a step of bending the clamping portions in a longitudinal direction of the electric wire.

In the terminal connection method according to the above (v), the clamping portions are gradually brought close to each other in a state where the conductor is disposed between the clamping portions, whereby it is possible to clamp and hold the strands of the conductor in a substantially uniform thickness while arranging in parallel the strands. In this way, the terminal is reliably connected while maintaining tensile strength and bendability, and thus it is possible to obtain good mechanical and electrical performance. Further, in the terminal connection method of the above (v), the clamping portions are bent in the longitudinal direction of the electric wire, and therefore, it is possible to enhance the rigidity of the clamping portion pressing the conductor. In this way, the rigidity of the clamping portion is prevented from being lower than the tensile strength of the conductor, and thus it is possible to reliably secure tensile strength.

Further, the terminal connection structure according to the present invention further includes the features of the following (1) to (4) for achieving the above-described object.

(1) A terminal connection structure in which a metal terminal is connected to an electric wire provided with a conductor composed of a plurality of strands, wherein the terminal has a plurality of clamping portions in which surfaces facing each other in a crimp state serve as clamping surfaces, and the plurality of clamping portions are crimped such that the respective clamping surfaces are substantially parallel to each other, thereby clamping the strands configuring the conductor, by the clamping surfaces.

(2) The terminal connection structure according to the above (1), wherein a portion on one side of the conductor is clamped by the clamping surfaces, and a portion on the other side of the conductor is folded back, and the portion on the other side of the conductor is further clamped by other clamping surfaces.

(3) The terminal connection structure according to the above (1) or (2), wherein the conductor is a fiber conductor composed of strands each made of a metal-plated fiber with electric conductivity imparted thereto by performing metal plating on the surface of the fiber.

(4) The terminal connection structure according to any one of the above (1) to (3), wherein the clamping surface of each of the clamping portions is chamfered at an edge portion intersecting the strands.

In the terminal connection structure having the configuration of the above (1), the clamping portions are crimped so as to be substantially parallel to each other, and therefore, the strands configuring the conductor are clamped and held in a substantially uniform thickness. In this way, it is possible to provide a terminal connection structure which is excellent in tensile strength and bendability.

In the terminal connection structure having the configuration of the above (2), the portion on one side of the conductor is clamped by the clamping surfaces, and the portion on the other side of the conductor is folded back and is clamped by other clamping surfaces, and therefore, the folded-back conductor can be also substantially equally clamped and held. Moreover, the conductor is folded back, thereby being clamped at two places, and therefore, the contact area with the terminal is about double, and thus it is possible to improve tensile strength and electrical performance in a connection place between the conductor and the terminal.

In the terminal connection structure having the configuration of the above (3), the fiber conductor is used, and therefore, while the terminal has more lightweight property, tensile strength of the terminal is not reduced by the fiber whose resistance to a shear force is low being damaged and the terminal is reliably connected so as to obtain good mechanical and electrical performance.

In the terminal connection structure having the configuration of the above (4), chamfering is performed on the edge portions intersecting the strands of the clamping surfaces, and therefore, it is possible to suppress the concentration of a clamping force to the strands at the edge portions of the clamping surfaces when the clamping portions are crimped and thus the strands are clamped by the clamping surfaces. In this way, it is possible to eliminate damage to the strands, clamp the conductor without a defect such as disconnection, and enhance connection reliability.

Further, the terminal connection structure according to the present invention further includes the features of the following (5) or (6) for achieving the above-described object.

(5) A terminal connection method of connecting a metal terminal to an electric wire provided with a conductor composed of a plurality of strands, including:

a step of disposing the conductor between a plurality of clamping portions provided in the terminal; and a step of gradually bringing the clamping portions close to each other, thereby crimping the clamping portions such that clamping surfaces composed of facing surfaces of the clamping portions are substantially parallel to each other, and thus clamping the conductor in substantially the same thickness.

(6) The terminal connection method according to the above (5), wherein a portion on one side of the conductor is clamped by the clamping surfaces, and a portion on the other side of the conductor is folded back and disposed between the clamping portion clamping the portion on one side of the conductor and the other clamping portion, and the clamping portions are gradually brought close to each other, thereby being crimped such that the clamping surfaces composed of the facing surfaces of the clamping portions are substantially parallel to each other, and thus the conductor is clamped in substantially the same thickness.

In the terminal connection method of the above (5), the clamping portions are gradually brought close to each other in a state where the conductor is disposed between the clamping portions, whereby it is possible to clamp and hold the strands of the conductor in a substantially uniform thickness while arranging in parallel the strands. In this way, the terminal is reliably connected while maintaining tensile strength and bendability, and thus it is possible to obtain good mechanical and electrical performance.

In the terminal connection method of the above (6), the conductor clamped by the clamping surfaces is folded back and clamped by other clamping surfaces in a state of being arranged in parallel in substantially the same thickness, and therefore, the folded-back conductor can be also substantially equally clamped and held. Moreover, the conductor is folded back, thereby being clamped at two places, and therefore, the contact area with the terminal is about double, and thus it is possible to improve tensile strength and electrical performance in a connection place between the conductor and the terminal.

The present invention has been briefly described above. In addition, the details of the present invention will be further clarified by reading through a mode for carrying out the invention which will be described below, with reference to the accompanying drawings.

DESCRIPTION OF EMBODIMENTS

Hereinafter, examples of embodiments according to the present invention will be described with reference to the drawings. In the following, a conductor of an electric wire will be described regarding as a fiber conductor.

First Embodiment

First, a terminal connection structure according to a first embodiment of the present invention will be described.

Figure 1:
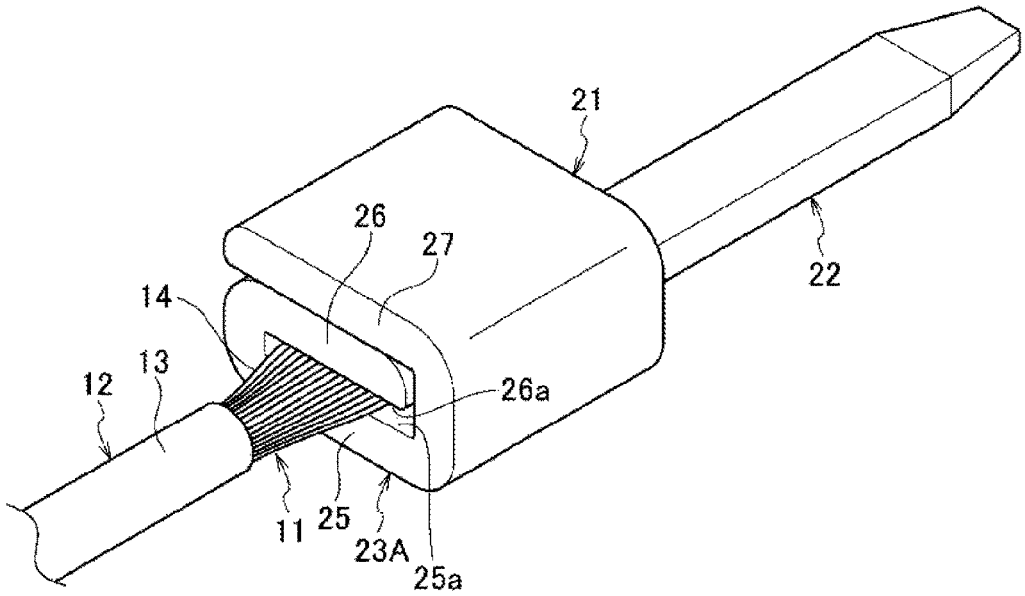
FIG. 1 is a perspective view of a connection place between an electric wire and a terminal, describing a terminal connection structure according to a first embodiment of the present invention.
Figure 2:
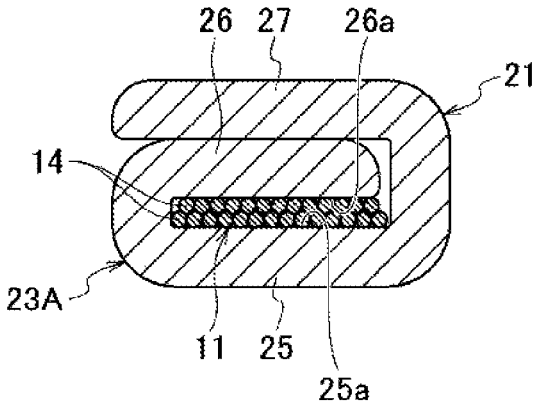
FIG. 2 is a cross-sectional view in a fixing portion of the terminal, describing the terminal connection structure according to the first embodiment of the present invention.
Figure 3:
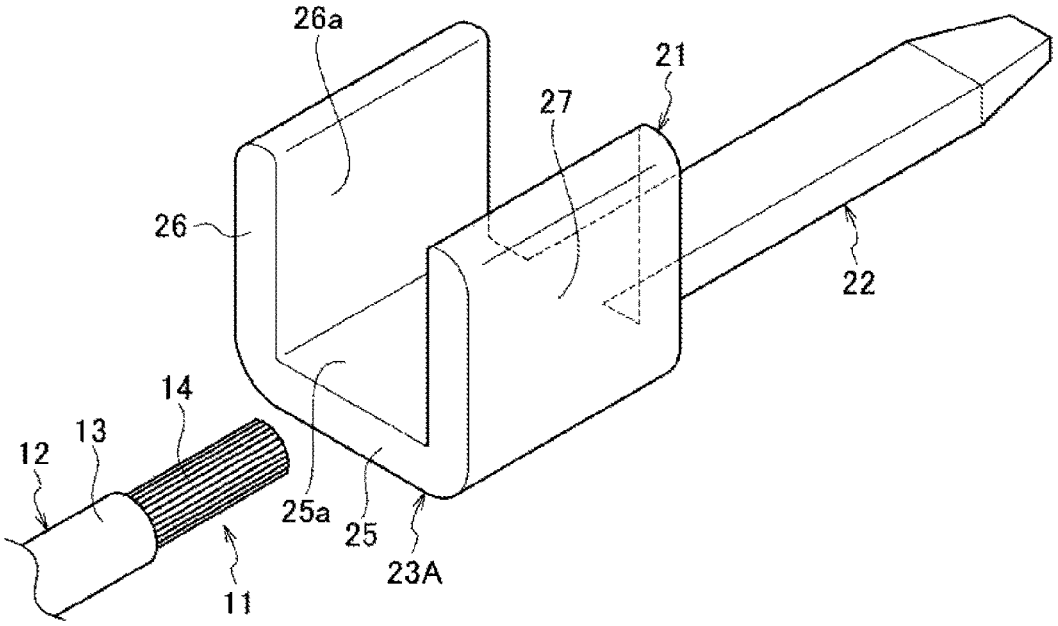
FIG. 3 is a perspective view of an end portion of the electric wire and the terminal before connection.

FIG. 1 is a perspective view of a connection place between an electric wire and a terminal, describing the terminal connection structure according to the first embodiment of the present invention, and FIG. 2 is a cross-sectional view in a fixing portion of the terminal, describing the terminal connection structure according to the first embodiment, and FIG. 3 is a perspective view of an end portion of the electric wire and the terminal before connection.

As shown in FIGS. 1 and 2, in the terminal connection structure according to the first embodiment, a terminal 21 is connected to an electric wire 12 having a fiber conductor 11.

In the electric wire 12, the circumference of the fiber conductor 11 is coated with an external coat 13 made of insulating resin and the fiber conductor 11 is configured by twisting a plurality of strands 14.

The strand 14 is made of a fiber having electric conductivity, such as a carbon fiber, for example, or a metal-plated fiber with electric conductivity imparted thereto by performing metal plating processing on a non-conductive fiber such as an aramid fiber. The fiber conductor 11 is configured by twisting the strands 14 each made of the metal-plated fiber, thereby being excellent in a reduction in weight, tensile strength, and bendability and being able to be used as a conductor of an ultra-fine electric wire. Further, as the strand 14, it is also possible to use a metal-plated fiber with electric conductivity imparted thereto by performing metal plating processing on a polyarylate fiber. The polyarylate fiber is particularly preferable in terms of having high strength and high elastic modulus and being excellent in wear resistance and dimensional stability. In addition, in this specification, a description is made regarding all the conductors of the electric wires as being fiber conductors. However, the conductor may include a common metal conductor in addition to the fiber conductor.

The terminal 21 which is connected to the electric wire 12 is formed of a conductive metal material such as pure copper, brass, or copper metal, for example, and has a tab portion 22 which is electrically connected to a counterpart terminal or the like, and a fixing portion 23A which is fixed to the electric wire 12, as shown in FIG. 3.

The fixing portion 23A is formed in a substantially U-shape when viewed in a cross section, with a flat plate portion (a clamping portion) 25 formed in a flat plate shape, a clamping plate portion (a clamping portion) 26 provided substantially perpendicular to the flat plate portion 25 from a side portion on one side in a longitudinal direction of the flat plate portion 25, and a pressing plate portion 27 provided likewise substantially perpendicular to the flat plate portion 25 from a side portion opposite to the clamping plate portion 26, of the flat plate portion 25.

When the electric wire 12 is connected to the terminal 21, as shown in FIG. 2, the fiber conductor 11 is clamped by the upper surface (that is, a clamping surface 25*a*) of the flat plate portion 25 and the inner surface (that is, a clamping surface 26*a*) of the clamping plate portion 26, and thus the terminal 21 is connected to the fiber conductor 11 in a conduction state. At this time, the clamping plate portion 26 is crimped to the flat plate portion 25 so as to be substantially parallel to each other with the fiber conductor 11 interposed therebetween.

In the fiber conductor 11, the strands 14 are arranged in parallel so as to be substantially the same thickness in a width direction along the clamping surfaces 25*a* and 26*a* which are the facing surfaces of the flat plate portion 25 and the clamping plate portion 26, between the flat plate portion 25 and the clamping plate portion 26. In this way, a clamping force by the flat plate portion 25 and the clamping plate portion 26 is substantially equally applied to the respective strands 14. Therefore, the terminal 21 is connected to the electric wire 12 in a state where the strands 14 of the fiber conductor 11 are clamped and held without deviation.

Further, the pressing plate portion 27 is bent so as to be substantially parallel to the flat plate portion 25 with the fiber conductor 11 and the clamping plate portion 26 interposed therebetween. In this way, the outer surface (that is, the surface on the side opposite to the clamping surface 26*a*) of the clamping plate portion 26 is pressed by the pressing plate portion 27, and thus a clamping state of the fiber conductor 11 between the flat plate portion 25 and the clamping plate portion 26 is maintained in a good state.

Next, a connection method of connecting the terminal 21 according to the first embodiment to the electric wire 12 will be described.

Figures 4A, 4B, 4C, 4D:
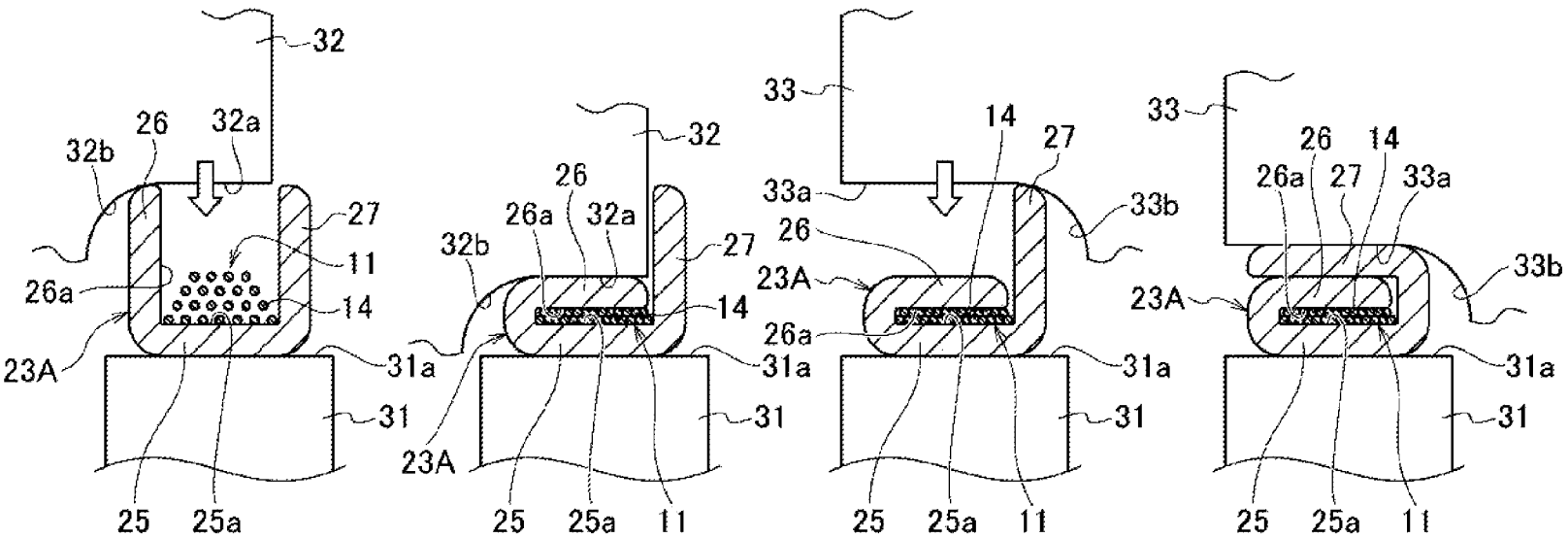
FIG. 4A is a cross-sectional view in a diagram describing a terminal connection process.
FIG. 4B is a cross-sectional view in a diagram describing the terminal connection process.
FIG. 4C is a cross-sectional view in a diagram describing the terminal connection process.
FIG. 4D is a cross-sectional view in a diagram describing the terminal connection process.

As shown in FIG. 4A, first, the fixing portion 23A of the terminal 21 is placed on an upper surface portion 31*a* of a lower die 31 formed in a plane shape, and the fiber conductor 11 of the electric wire 12 is disposed on the clamping surface 25*a* which is the upper surface of the flat plate portion 25 in the fixing portion 23A.

In this state, a first upper die 32 descends. The first upper die 32 has a plane portion 32*a* and a curved surface portion 32*b* curved in an arc shape on the inner side which is continuous to the plane portion 32*a*, and the curved surface portion 32*b* is disposed on the clamping plate portion 26 side.

If the first upper die 32 descends, the curved surface portion 32*b* of the first upper die 32 comes into contact with an end portion of the clamping plate portion 26, whereby the end portion of the clamping plate portion 26 is displaced along the curved surface portion 32*b*, thereby being gradually pushed down to the flat plate portion 25 side. If the clamping plate portion 26 is tilted by the descent of the first upper die 32, the strands 14 configuring the fiber conductor 11 on the flat plate portion 25 are gradually arranged in parallel in substantially the same thickness on the flat plate portion 25.

If the first upper die 32 completely descends, as shown in FIG. 4B, the entirety of the clamping plate portion 26 comes into contact with the plane portion 32*a* of the first upper die 32 and is pressed to the flat plate portion 25 side by the plane portion 32*a*, and thus the flat plate portion 25 and the clamping plate portion 26 are substantially parallel to each other. In this way, the strands 14 of the fiber conductor 11 aligned in substantially the same thickness on the clamping surface 25*a* of the flat plate portion 25 are pressed against the flat plate portion 25 by the clamping surface 26*a* of the clamping plate portion 26 and clamped by the clamping surface 25*a* of the flat plate portion 25 and the clamping surface 26*a* of the clamping plate portion 26.

Next, as shown in FIG. 4C, a second upper die 33 descends. The second upper die 33 has a plane portion 33*a* and a curved surface portion 33*b* curved in an arc shape on the inner side which is continuous to the plane portion 33*a*, and the curved surface portion 33*b* is disposed on the pressing plate portion 27 side.

If the second upper die 33 descends, the curved surface portion 33*b* of the second upper die 33 comes into contact with an end portion of the pressing plate portion 27, whereby the end portion of the pressing plate portion 27 is displaced along the curved surface portion 33*b*, thereby being gradually pushed down to the side of the clamping plate portion 26 superimposed on the flat plate portion 25.

If the second upper die 33 completely descends, as shown in FIG. 4D, the entirety of the pressing plate portion 27 comes into contact with the plane portion 33*a* of the second upper die 33 and is pressed to the clamping plate portion 26 side by the plane portion 33*a*, and thus the pressing plate portion 27 is superimposed on the clamping plate portion 26. In this way, the surface on the side opposite to the surface facing the flat plate portion 25, of the clamping plate portion 26, is pressed by the pressing plate portion 27, and thus a clamping state of the fiber conductor 11 between the flat plate portion 25 and the clamping plate portion 26 is maintained in a good state.

In this manner, according to the terminal connection structure according to the first embodiment, the strands 14 configuring the fiber conductor 11 are clamped in a state of being arranged in parallel in substantially the same thickness by the respective clamping surfaces 25*a* and 26*a* of the flat plate portion 25 and the clamping plate portion 26, and therefore, the respective strands 14 are substantially equally clamped and held.

Moreover, in a state where the fiber conductor 11 is disposed between the flat plate portion 25 and the clamping plate portion 26, the flat plate portion 25 and the clamping plate portion 26 are gradually brought close to each other, whereby the strands 14 of the fiber conductor 11 can be substantially equally clamped and held.

In this way, the fiber conductor 11 in which while a reduction in weight, tensile strength, and bendability are excellent, resistance to a shear force is low is not damaged, and the terminal 21 is not reduced in tensile strength by the fiber conductor 11, and bendability are excellent, resistance to a shear force is low being damaged, and the terminal 21 is reliably connected so as to obtain good mechanical and electrical performance.

Next, modification examples of the terminal connection structure according to the first embodiment will be described.

Modification Example 1

Figure 5:
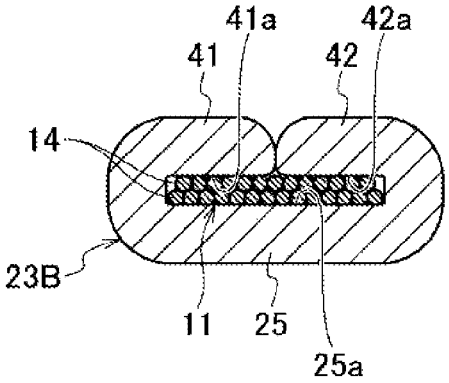
FIG. 5 is a cross-sectional view in a fixing portion of a terminal, describing a terminal connection structure according to Modification Example 1.

As shown in FIG. 5, in a terminal connection structure according to Modification Example 1, a pair of clamping plate portions (clamping portions) 41 and 42 each having a width dimension of approximately half of the flat plate portion 25 is formed at both side portions of the flat plate portion (the clamping portion) 25 of a fixing portion 23B. Then, in the fixing portion 23B of the terminal 21, the pair of clamping plate portions 41 and 42 is crimped so as to be substantially parallel to the flat plate portion 25, whereby the strands 14 of the fiber conductor 11 are clamped in a state of being arranged in parallel in substantially the same thickness, by the clamping surface 25*a* of the flat plate portion 25 and clamping surfaces 41*a* and 42*a* of the clamping plate portions 41 and 42.

Figure 6A:
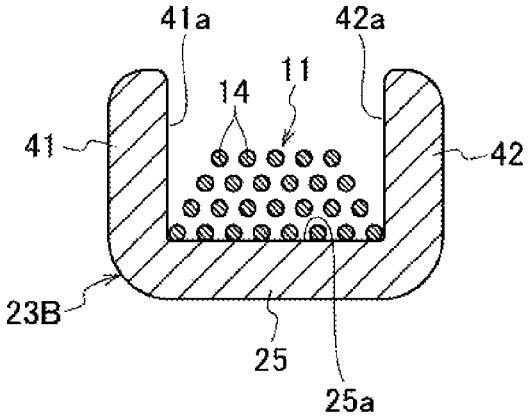
FIG. 6A is a cross-sectional view in a diagram describing a terminal connection process according to Modification Example 1 FIG.
Figure 6B:
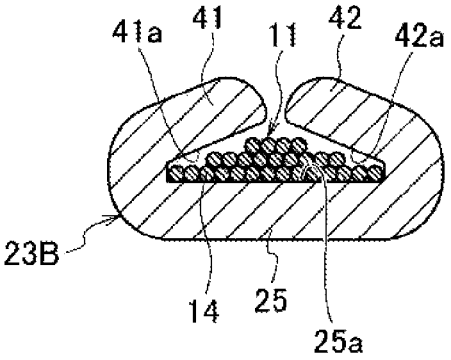
FIG. 6B is a cross-sectional view in a diagram describing the terminal connection process according to Modification Example 1.

In order to connect the terminal 21 having the fixing portion 23B to the fiber conductor 11 of the electric wire 12, first, as shown in FIG. 6A, in a state where the clamping plate portions 41 and 42 are provided to be erect, the fiber conductor 11 is disposed on the clamping surface 25*a* which is the upper surface of the flat plate portion 25. Next, as shown in FIG. 6B, the respective clamping plate portions 41 and 42 are gradually pushed down to the inside and pressed to the flat plate portion 25 side so as to be substantially parallel to the flat plate portion 25.

Then, a state is created where the strands 14 of the fiber conductor 11 are arranged in parallel in substantially the same thickness and clamped by the clamping surface 25*a* of the flat plate portion 25 and the clamping surfaces 41*a* and 42*a* of the respective clamping plate portions 41 and 42 (refer to FIG. 5).

Modification Example 2

Figure 7:
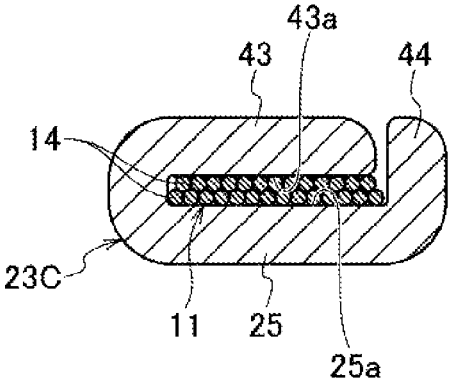
FIG. 7 is a cross-sectional view in a fixing portion of a terminal, describing a terminal connection structure according to Modification Example 2.

As shown in FIG. 7, in a terminal connection structure according to Modification Example 2, a clamping plate portion (a clamping portion) 43 having a width dimension of approximately the entirety of the flat plate portion 25 is formed at one side portion of the flat plate portion (the clamping portion) 25 of a fixing portion 23C. Further, an engagement piece portion 44 protruding upward in substantially the same protrusion dimension as the thickness of the clamping plate portion 43 is formed at the other side portion of the flat plate portion 25. Then, in the fixing portion 23C of the terminal 21, the strands 14 of the fiber conductor 11 are clamped in a state of being arranged in parallel in substantially the same thickness, by the clamping surface 25*a* of the flat plate portion 25 and a clamping surface 43*a* of the clamping plate portion 43.

Figure 8A:
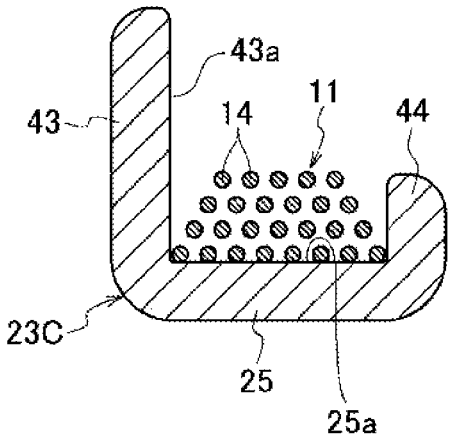
FIG. 8A is a cross-sectional view in a diagram describing a terminal connection process according to Modification Example 2 FIG.
Figure 8B:
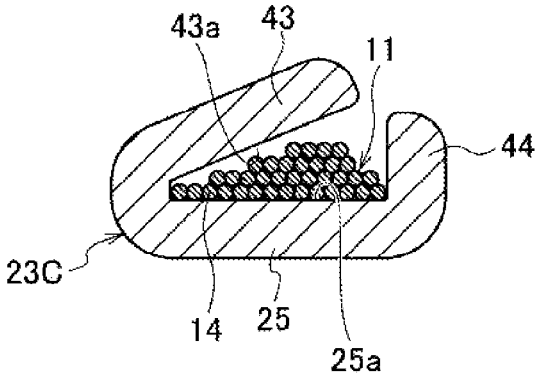
FIG. 8B is a cross-sectional view in a diagram describing the terminal connection process according to Modification Example 2.

In order to connect the terminal 21 having the fixing portion 23C to the fiber conductor 11 of the electric wire 12, first, as shown in FIG. 8A, in a state where the clamping plate portion 43 is provided to be erect, the fiber conductor 11 is disposed on the clamping surface 25*a* of the flat plate portion 25. Next, as shown in FIG. 8B, the clamping plate portion 43 is gradually pushed down to the inside and pressed to the flat plate portion 25 side so as to be substantially parallel to the flat plate portion 25.

Then, a state is created where the strands 14 of the fiber conductor 11 are arranged in parallel in substantially the same thickness and clamped by the clamping surface 25*a* of the flat plate portion 25 and the clamping surface 43*a* of the clamping plate portion 43 (refer to FIG. 7).

Modification Example 3

Figure 9:
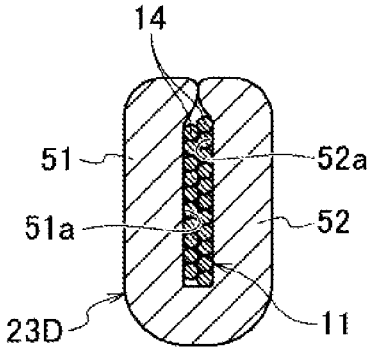
FIG. 9 is a cross-sectional view in a fixing portion of a terminal, describing a terminal connection structure according to Modification Example 3.

As shown in FIG. 9, in a terminal connection structure according to Modification Example 3, a fixing portion 23D of the terminal 21 is formed with a pair of clamping plate portions (clamping portions) 51 and 52 connected to each other at one side portion. Then, in the fixing portion 23D of the terminal 21, the pair of clamping plate portions 51 and 52 is crimped so as to be substantially parallel to each other, whereby the strands 14 of the fiber conductor 11 are clamped in a state of being arranged in parallel in substantially the same thickness, by clamping surface 51*a* and 52*a* of the pair of clamping plate portions 51 and 52.

Figure 10:
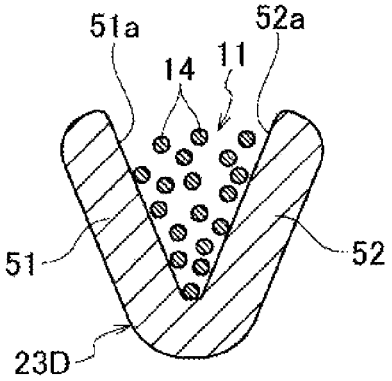
FIG. 10 is a cross-sectional view describing a terminal connection process according to Modification Example 3.

In order to connect the terminal 21 having the fixing portion 23D to the fiber conductor 11 of the electric wire 12, as shown in FIG. 10, the fiber conductor 11 is disposed between the clamping plate portions 51 and 52 in a state of being open at a predetermined angle, and the respective clamping plate portions 51 and 52 are pressed in a direction in which the clamping plate portions 51 and 52 gradually come close to each other, and are pressed until the clamping plate portions 51 and 52 are substantially parallel to each other.

Then, a state is created where the strands 14 of the fiber conductor 11 are arranged in parallel in substantially the same thickness and clamped by the clamping surfaces 51*a* and 52*a* of the respective clamping plate portions 51 and 52 (refer to FIG. 9).

Modification Example 4

Figure 11:
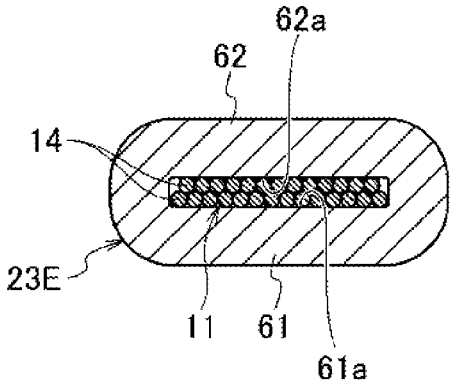
FIG. 11 is a cross-sectional view in a fixing portion of a terminal, describing a terminal connection structure according to Modification Example 4.

As shown in FIG. 11, in a terminal connection structure according to Modification Example 4, a fixing portion 23E of the terminal 21 has a pair of clamping plate portions (clamping portions) 61 and 62 connected to each other at both side portions, and thus the fixing portion 23E is configured in a ring shape as a whole. The pair of clamping plate portions 61 and 62 is crimped so as to be substantially parallel to each other, and thus the strands 14 of the fiber conductor 11 are clamped in a state of being arranged in parallel in substantially the same thickness, by clamping surface 61*a* and 62*a* of the clamping plate portions 61 and 62.

In order to connect the terminal 21 having the fixing portion 23E to the fiber conductor 11 of the electric wire 12, the fiber conductor 11 is disposed in the fixing portion 23E having a ring shape, and the fixing portion 23E is pressed from two opposite directions by dies having flat surfaces. Then, a state is created where the strands 14 of the fiber conductor 11 are arranged in parallel in substantially the same thickness and clamped by the clamping surfaces 61*a* and 62*a* of the pair of clamping plate portions 61 and 62.

Modification Example 5

Figure 12:
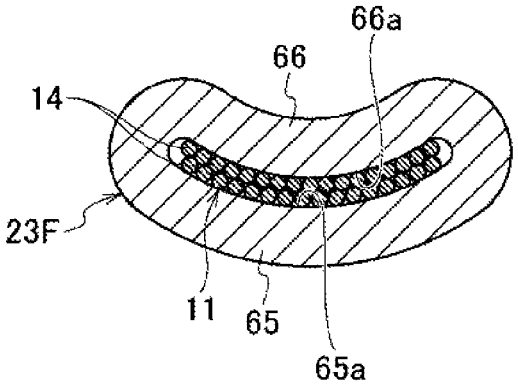
FIG. 12 is a cross-sectional view in a fixing portion of a terminal, describing a terminal connection structure according to Modification Example 5.

As shown in FIG. 12, in a terminal connection structure according to Modification Example 5, a fixing portion 23F of the terminal 21 has a pair of clamping plate portions (clamping portions) 65 and 66 connected to each other at both side portions, and thus the fixing portion 23F is configured in a ring shape as a whole. The pair of clamping plate portions 65 and 66 is crimped so as to be substantially parallel to each other, and thus the strands 14 of the fiber conductor 11 are clamped in a state of being arranged in parallel in substantially the same thickness, by clamping surface 65*a* and 66*a* of the clamping plate portions 65 and 66.

In order to connect the terminal 21 having the fixing portion 23F to the fiber conductor 11 of the electric wire 12, the fiber conductor 11 is disposed in the fixing portion 23F having a ring shape, and the fixing portion 23F is pressed from two opposite directions by dies having surfaces curved in an arc shape. Then, a state is created where the strands 14 of the fiber conductor 11 are arranged in parallel in substantially the same thickness and clamped by the clamping surfaces 65*a* and 66*a* of the pair of clamping plate portions 65 and 66.

Modification Example 6

Figure 13:
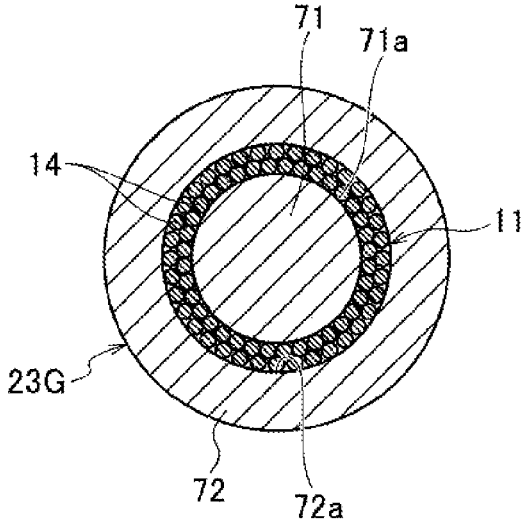
FIG. 13 is a cross-sectional view in a fixing portion of a terminal, describing a terminal connection structure according to Modification Example 6.

As shown in FIG. 13, in a terminal connection structure according to Modification Example 6, a fixing portion 23G of the terminal 21 has a core (a clamping portion) 71 having a circular cross section, and a cylindrical material (a clamping portion) 72 provided so as to cover the circumference of the core 71, and the strands 14 of the fiber conductor 11 are clamped in a state of being arranged in parallel in a ring shape having substantially the same thickness, by a clamping surface 71*a* composed of the outer peripheral surface of the core 71 and a clamping surface 72*a* composed of the inner peripheral surface of the cylindrical material 72. Also in the case of the fixing portion 23G having the core 71 and the cylindrical material 72, a state is created where the circumference of an annular space with the strands 14 of the fiber conductor 11 arranged therein is closed.

Second Embodiment

Next, a terminal connection structure according to a second embodiment of the present invention will be described with reference to the drawings.

Figure 14:
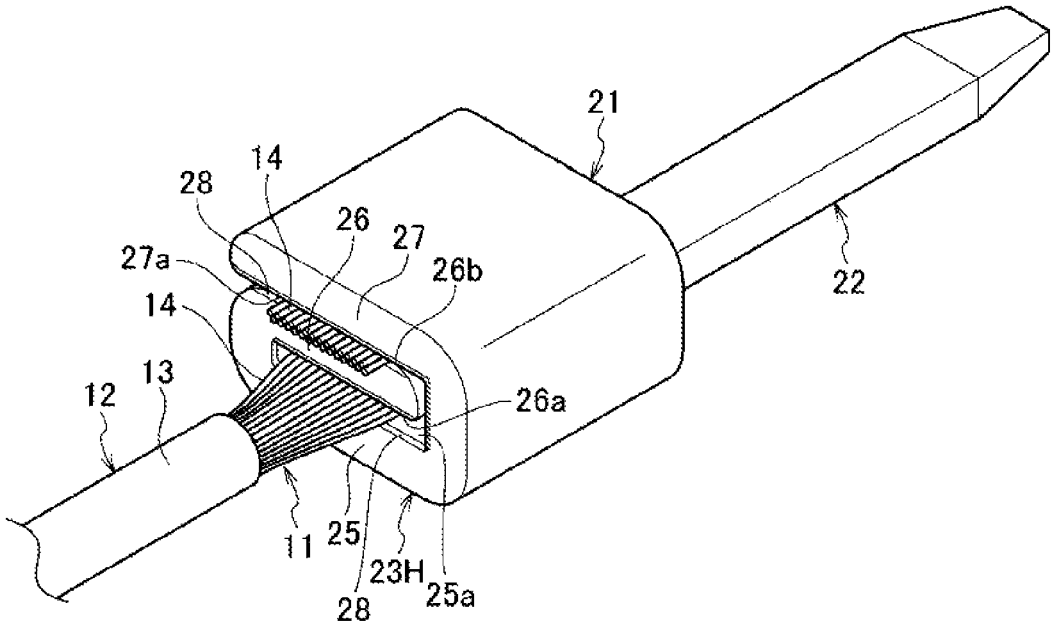
FIG. 14 is a perspective view of a connection place between an electric wire and a terminal, describing a terminal connection structure according to a second embodiment of the present invention.
Figure 15:
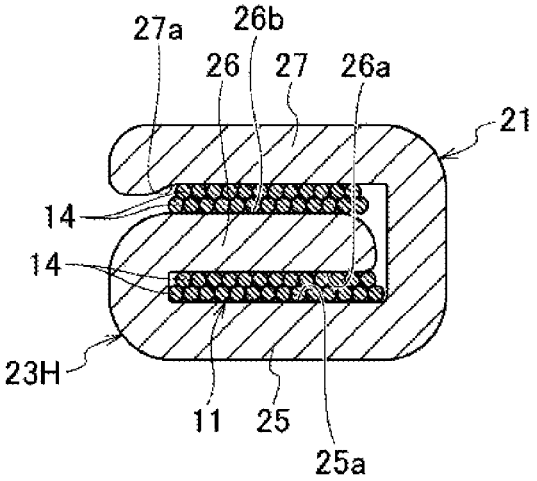
FIG. 15 is a cross-sectional view in a fixing portion of the terminal, describing the terminal connection structure according to the second embodiment of the present invention.
Figure 16:
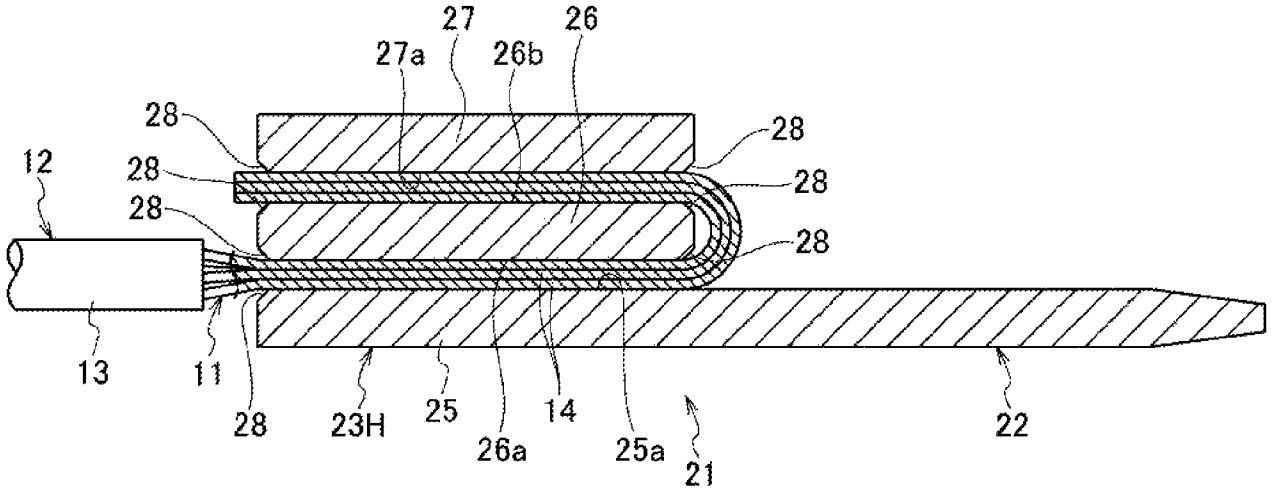
FIG. 16 is a sectional view along a longitudinal direction of the terminal, describing the terminal connection structure according to the second embodiment of the present invention.
Figure 17:
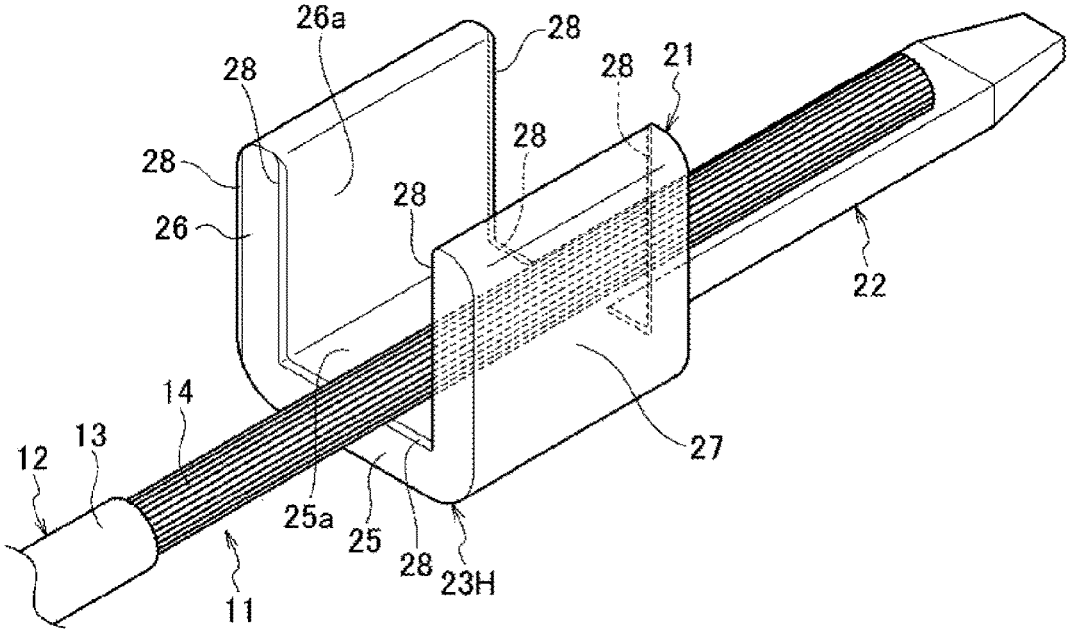
FIG. 17 is a perspective view of an end portion of the electric wire and the terminal before connection.

FIG. 14 is a perspective view of a connection place between an electric wire and a terminal, describing the terminal connection structure according to the second embodiment of the present invention, and FIG. 15 is a cross-sectional view in a fixing portion of the terminal, describing the terminal connection structure according to the second embodiment, and FIG. 16 is a sectional view along a longitudinal direction of the terminal, describing the terminal connection structure according to the second embodiment, and FIG. 17 is a perspective view of an end portion of the electric wire and the terminal before connection.

As shown in FIGS. 14 to 16, also in the terminal connection structure according to the second embodiment, the terminal 21 is connected to the electric wire 12 having the fiber conductor 11.

In the electric wire 12, the circumference of the fiber conductor 11 is coated with the external coat 13 made of insulating resin and the fiber conductor 11 is configured by twisting the plurality of strands 14.

The strand 14 is made of a fiber having electric conductivity, such as a carbon fiber, for example, or a metal-plated fiber with electric conductivity imparted thereto by performing metal plating processing on a non-conductive fiber such as an aramid fiber. The fiber conductor 11 is configured by twisting the strands 14 made of the metal-plated fiber, thereby being excellent in a reduction in weight, tensile strength, and bendability and being able to be used as a conductor of an ultra-fine electric wire. Further, as the strand 14, it is also possible to use a metal-plated fiber with electric conductivity imparted thereto by performing metal plating processing on a polyarylate fiber. The polyarylate fiber is particularly preferable in terms of having high strength and high elastic modulus and being excellent in wear resistance and dimensional stability.

The terminal 21 which is connected to the electric wire 12 is formed of a conductive metal material such as pure copper, brass, or copper metal, for example, and has the tab portion 22 which is electrically connected to a counterpart terminal or the like, and a fixing portion 23H which is fixed to the electric wire 12, as shown in FIG. 17.

The fixing portion 23H is formed in a substantially U-shape when viewed in a cross section, with the flat plate portion (the clamping portion) 25 formed in a flat plate shape, the clamping plate portion (the clamping portion) 26 provided substantially perpendicular to the flat plate portion 25 from a side portion on one side in the longitudinal direction of the flat plate portion 25, and the pressing plate portion 27 provided likewise substantially perpendicular to the flat plate portion 25 from a side portion opposite to the clamping plate portion 26, of the flat plate portion 25.

Further, as shown in FIGS. 16 and 17, chamfering is performed on edge portions intersecting the strands 14 of the fiber conductor 11, of the clamping surface 25*a* composed of the upper surface of the flat plate portion 25, the clamping surface 26*a* composed of the inner surface of the clamping plate portion 26, a clamping surface 26*b* composed of the outer surface of the clamping plate portion 26, and a clamping surface 27*a* composed of the inner surface of the pressing plate portion 27. Specifically, at the edge portions intersecting the strands 14, of the clamping surfaces 25*a*, 26*a*, 26*b*, and 27*a*, tapered surfaces 28 are formed by performing C-chamfering on the edge portions.

When the electric wire 12 is connected to the terminal 21, as shown in FIGS. 15 and 16, the fiber conductor 11 is clamped by the upper surface (that is, the clamping surface 25*a*) of the flat plate portion 25 and the inner surface (that is, the clamping surface 26*a*) of the clamping plate portion 26, and thus the terminal 21 is connected to the fiber conductor 11 in a conduction state. Then, a leading end portion of the fiber conductor 11, which protrudes from the fixing portion 23H, is folded back, and the folded-back portion is clamped by the outer surface (that is, the clamping surface 26*b*) of the clamping plate portion 26 and the inner surface (that is, the clamping surface 27*a*) of the pressing plate portion 27. At this time, the clamping plate portion 26 and the pressing plate portion 27 are crimped to the flat plate portion 25 so as to be substantially parallel to each other with the fiber conductor 11 interposed therebetween.

In the fiber conductor 11, the strands 14 are arranged in parallel so as to be substantially the same thickness in the width direction along the clamping surfaces 25*a* and 26*a* which are the facing surfaces of the flat plate portion 25 and the clamping plate portion 26, between the flat plate portion 25 and the clamping plate portion 26. Then, in the fiber conductor 11 folded back, the strands 14 are arranged in parallel so as to be substantially the same thickness in the width direction along the clamping surfaces 26*b* and 27*a* which are the facing surfaces of the clamping plate portion 26 and the pressing plate portion 27, between the clamping plate portion 26 and the pressing plate portion 27. In this way, the clamping forces by the flat plate portion 25, the clamping plate portion 26, and the pressing plate portion 27 are substantially equally applied to the respective strands 14. In this way, the terminal 21 is connected to the electric wire 12 in a state where the strands 14 of the fiber conductor 11 are clamped and held without deviation.

In this way, the fiber conductor 11 is clamped by the clamping surface 25*a* of the flat plate portion 25 and the clamping surface 26*a* of the clamping plate portion 26 and also clamped by the clamping surface 26*b* of the clamping plate portion 26 and the clamping surface 27*a* of the pressing plate portion 27, as shown in FIG. 14, and thus the contact area with the terminal 21 is about double. In this way, tensile strength and electrical performance in the connection place between the fiber conductor 11 and the terminal 21 are improved.

Further, if the fiber conductor 11 is folded back and connected in this manner, although a thickness dimension is somewhat bulky, it is possible to suppress a width dimension.

Moreover, the pressing plate portion 27 is bent in substantially parallel to the flat plate portion 25 with the fiber conductor 11 and the clamping plate portion 26 interposed therebetween. In this way, the clamping surface 26*b* of the clamping plate portion 26 is pressed by the pressing plate portion 27 with the strands 14 interposed therebetween, and thus a clamping state of the fiber conductor 11 between the flat plate portion 25 and the clamping plate portion 26 is maintained in a good state.

Further, the edge portions intersecting the strands 14, of the clamping surfaces 25*a*, 26*a*, 26*b*, and 27*a*, are chamfered, and therefore, the concentration of the clamping force to the strands 14 in the edge portions of the clamping surfaces 25*a*, 26*a*, 26*b*, and 27*a* is suppressed when the clamping plate portion 26 and the pressing plate portion 27 are crimped and thus the strands 14 are clamped by the clamping surfaces 25*a*, 26*a*, 26*b*, and 27*a*. In this way, it is possible to eliminate damage to the strands 14, favorably clamp the fiber conductor 11 without a defect such as disconnection, and increase connection reliability.

Figure 18:
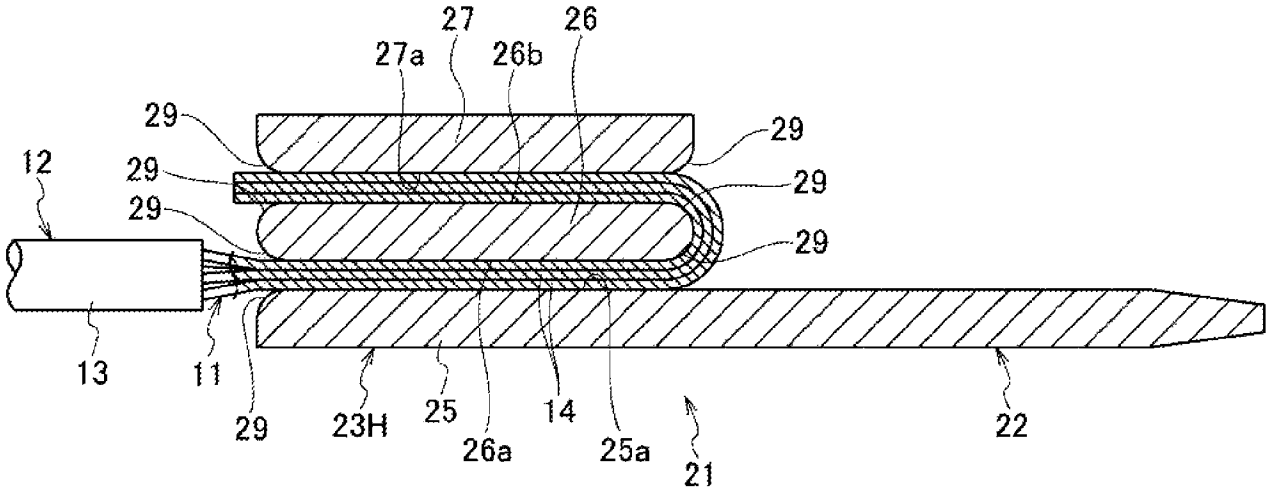
FIG. 18 is a sectional view along a longitudinal direction of a terminal, describing a terminal connection structure according to a modification example of the second embodiment of the present invention.

In addition, arcuate surfaces 29 may be formed by performing R-chamfering, as shown in FIG. 18, as the chamfering of the edge portions intersecting the strands 14, of the clamping surfaces 25*a*, 26*a*, 26*b*, and 27*a*. In this manner, also in a case where the edge portions intersecting the strands 14, of the clamping surfaces 25*a*, 26*a*, 26*b*, and 27*a*, are chamfered in an arc shape, the concentration of the clamping force to the strands 14 in the edge portions of the clamping surfaces 25*a*, 26*a*, 26*b*, and 27*a* is suppressed when the clamping plate portion 26 and the pressing plate portion 27 are crimped and thus the strands 14 are clamped by the clamping surfaces 25*a*, 26*a*, 26*b*, and 27*a*. In this way, it is possible to eliminate damage to the strands 14, favorably clamp the fiber conductor 11 without a defect such as disconnection, and increase connection reliability.

In particular, it is preferable that the edge portions on the tab portion 22 side of the clamping surfaces 26*a* and 26*b* of the clamping plate portion 26 which is located on the inside of the folded-back portions of the strands 14 is formed in a continuous arc shape. In this way, even if a tensile force occurs in the electric wire 12 and thus the folded-back portion of the fiber conductor 11 is pressed against the clamping plate portion 26, the concentration of a pressing force to the clamping plate portion 26 due to the tensile force is prevented, and thus the breaking of the strands 14 configuring the fiber conductor 11 is suppressed.

In addition, in the arcuate surface 29 which is formed by performing R-chamfering, it is preferable that the radius of the arc thereof is greater than or equal to 0.45 mm, and if the radius of the arc is greater than or equal to 0.45 mm, the effect of preventing the breaking of the fiber conductor 11 due to the tension of the electric wire 12 is enhanced.

Next, a connection method of connecting the terminal 21 according to the second embodiment to the electric wire 12 will be described.

Figures 19A, 19B, 19C, 19D:
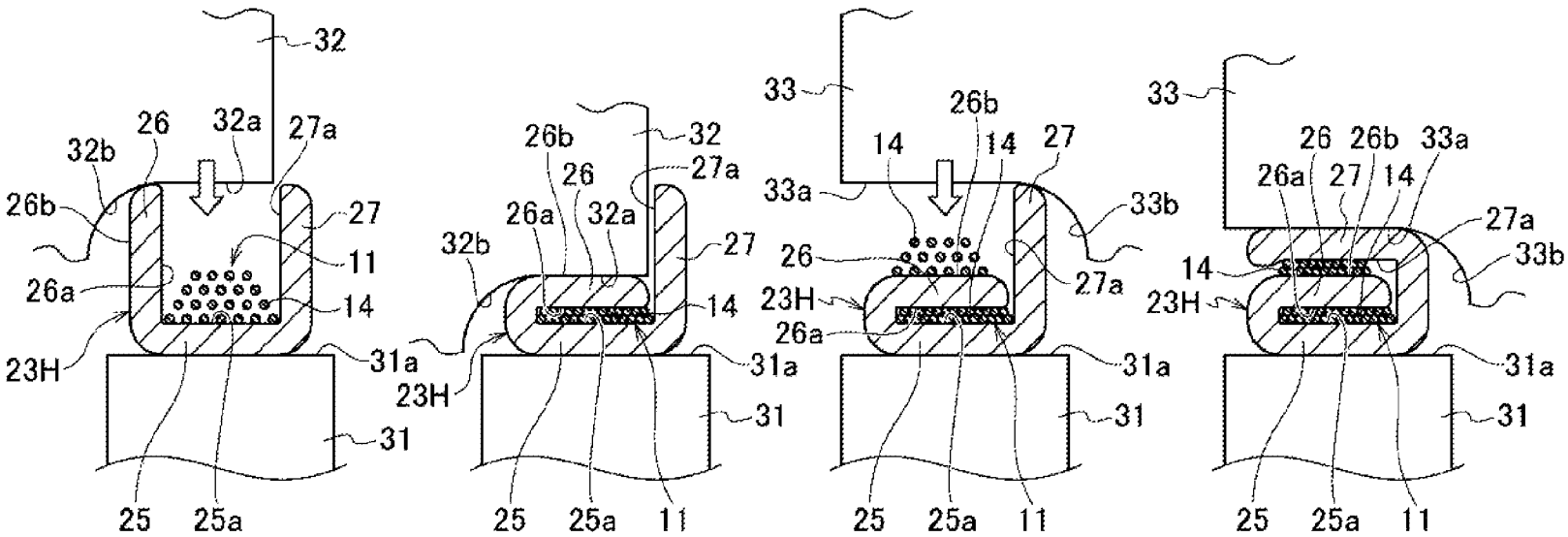
FIG. 19A is a cross-sectional view in a diagram describing a terminal connection process.
FIG. 19B is a cross-sectional view in a diagram describing the terminal connection process.
FIG. 19C is a cross-sectional view in a diagram describing the terminal connection process.
FIG. 19D is a cross-sectional view in a diagram describing the terminal connection process.
Figure 20A:
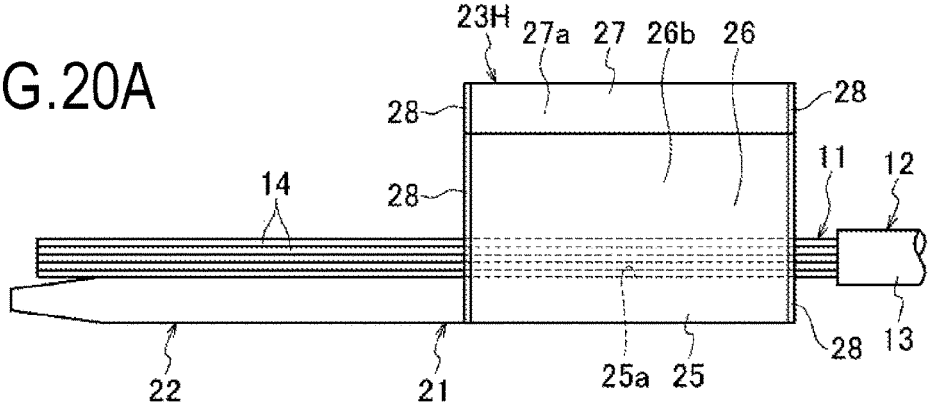
FIG. 20A is a schematic side view along a longitudinal direction of the terminal in a diagram describing the terminal connection process.

As shown in FIG. 19A, first, the fixing portion 23H of the terminal 21 is placed on the upper surface portion 31*a* of the lower die 31 formed in a plane shape, and then, as shown in FIG. 20A, a base end portion of the fiber conductor 11 of the electric wire 12 is disposed on the clamping surface 25*a* which is the upper surface of the flat plate portion 25 in the fixing portion 23H. In addition, at an end portion of the electric wire 12, the fiber conductor 11 is exposed longer.

In this state, the first upper die 32 descends. The first upper die 32 has the plane portion 32*a* and the curved surface portion 32*b* curved in an arc shape on the inner side which is continuous to the plane portion 32*a*, and the curved surface portion 32*b* is disposed on the clamping plate portion 26 side.

If the first upper die 32 descends, the curved surface portion 32*b* of the first upper die 32 comes into contact with an end portion of the clamping plate portion 26, whereby the end portion of the clamping plate portion 26 is displaced along the curved surface portion 32*b*, thereby being gradually pushed down to the flat plate portion 25 side. If the clamping plate portion 26 is tilted due to the descent of the first upper die 32, the strands 14 configuring the fiber conductor 11 on the flat plate portion 25 are gradually arranged in parallel in substantially the same thickness on the flat plate portion 25.

Figure 20B:
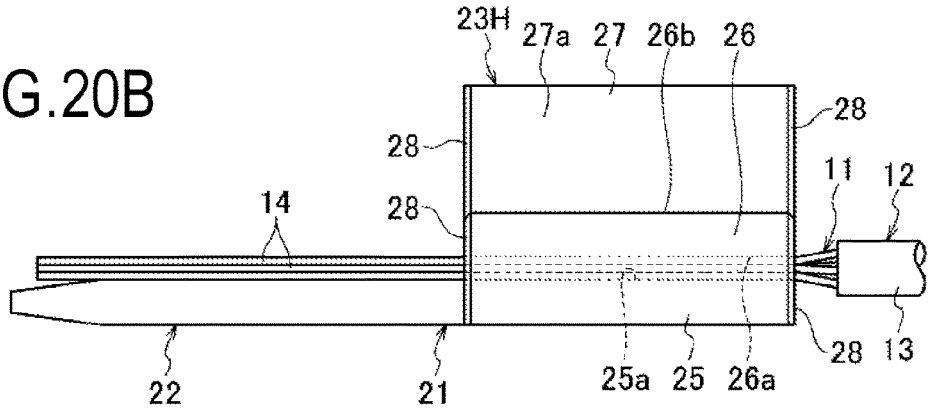
FIG. 20B is a schematic side view along the longitudinal direction of the terminal in a diagram describing the terminal connection process.

If the first upper die 32 completely descends, as shown in FIG. 19B and FIG. 20B, the entirety of the clamping plate portion 26 comes into contact with the plane portion 32*a* of the first upper die 32 and is pressed to the flat plate portion 25 side by the plane portion 32*a*, and thus the flat plate portion 25 and the clamping plate portion 26 are substantially parallel to each other. In this way, the strands 14 of the fiber conductor 11 aligned in substantially the same thickness on the clamping surface 25*a* of the flat plate portion 25 are pressed against the flat plate portion 25 by the clamping surface 26*a* of the clamping plate portion 26 and clamped by the clamping surface 25*a* of the flat plate portion 25 and the clamping surface 26*a* of the clamping plate portion 26.

At this time, chamfering is performed on the edge portions intersecting the strands 14, of the clamping surfaces 25*a* and 26*a*, and therefore, the concentration of the clamping force to the strands 14 in the edge portions of the clamping surfaces 25*a* and 26*a* is suppressed when the clamping plate portion 26 is crimped and thus the strands 14 are clamped by the clamping surfaces 25*a* and 26*a*, and thus the breaking of the strands 14 is prevented.

Figure 20C:
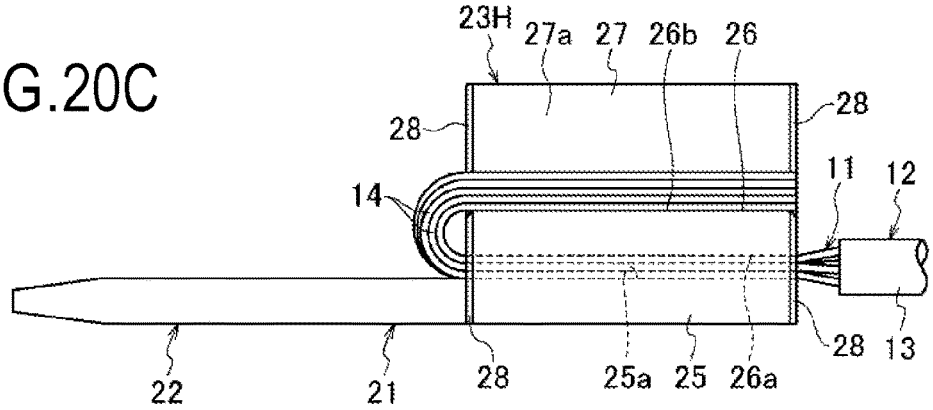
FIG. 20C is a schematic side view along the longitudinal direction of the terminal in a diagram describing the terminal connection process.

Next, as shown in FIG. 19C and FIG. 20C, the leading end side (a portion protruding from the fixing portion 23H) of the fiber conductor 11 is folded back and disposed on the clamping surface 26*b* composed of the outer surface of the clamping plate portion 26.

In this state, the second upper die 33 descends. The second upper die 33 has the plane portion 33*a* and the curved surface portion 33*b* curved in an arc shape on the inner side which is continuous to the plane portion 33*a*, and the curved surface portion 33*b* is disposed on the pressing plate portion 27 side.

If the second upper die 33 descends, the curved surface portion 33*b* of the second upper die 33 comes into contact with an end portion of the pressing plate portion 27, whereby the end portion of the pressing plate portion 27 is displaced along the curved surface portion 33*b*, thereby being gradually pushed down to the side of the clamping plate portion 26 superimposed on the flat plate portion 25.

Figure 20D:
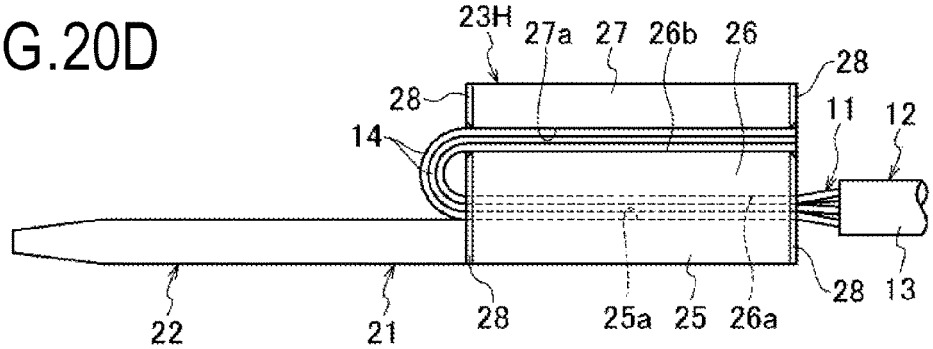
FIG. 20D is a schematic side view along the longitudinal direction of the terminal in a diagram describing the terminal connection process.

If the second upper die 33 completely descends, as shown in FIG. 19D and FIG. 20D, the entirety of the pressing plate portion 27 comes into contact with the plane portion 33*a* of the second upper die 33 and is pressed to the clamping plate portion 26 side by the plane portion 33*a*, and thus the clamping plate portion 26 and the pressing plate portion 27 are substantially parallel to each other. In this way, the strands 14 of the fiber conductor 11 aligned in substantially the same thickness on the clamping surface 26*b* of the clamping plate portion 26 are pressed against the clamping plate portion 26 by the clamping surface 27*a* of the pressing plate portion 27 and clamped by the clamping surface 26*b* of the clamping plate portion 26 and the clamping surface 27*a* of the pressing plate portion 27.

At this time, chamfering is performed on the edge portions intersecting the strands 14, of the clamping surfaces 26*b* and 27*a*, and therefore, the concentration of the clamping force to the strands 14 in the edge portions of the clamping surfaces 26*b* and 27*a* is suppressed when the pressing plate portion 27 is crimped and thus the strands 14 are clamped by the clamping surfaces 26*b* and 27*a*, and thus the breaking of the strands 14 is prevented.

Further, the pressing plate portion 27 is superimposed on the clamping plate portion 26, whereby the clamping surface 26*b* on the side opposite to the surface facing the flat plate portion 25, of the clamping plate portion 26, is pressed by the pressing plate portion 27, and thus a clamping state of the fiber conductor 11 between the flat plate portion 25 and the clamping plate portion 26 is maintained in a good state.

In this manner, according to the terminal connection structure according to the second embodiment, portions on one side (base end portions) of the strands 14 configuring the fiber conductor 11 are clamped in a state of being arranged in parallel in substantially the same thickness by the respective clamping surfaces 25*a* and 26*a* of the flat plate portion 25 and the clamping plate portion 26, and therefore, the respective strands 14 are substantially equally clamped and held. Further, portions on the other side (leading end portions) of the strands 14 are folded back and clamped in a state of being arranged in parallel in substantially the same thickness by the clamping surface 26*b* of the clamping plate portion 26 and the clamping surface 27*a* of the pressing plate portion 27, and therefore, the folded-back strands 14 can also be substantially equally clamped and held.

Moreover, the strands 14 are folded back, thereby being clamped at two places, and therefore, the contact area with the terminal 21 is about double, and thus it is possible to improve tensile strength and electrical performance in the connection place between the fiber conductor 11 and the terminal 21.

Further, chamfering is performed on the edge portions intersecting the strands 14, of the clamping surfaces 25*a*, 26*a*, 26*b*, and 27*a*, and therefore, it is possible to suppress the concentration of the clamping force to the strands 14 in the edge portions of the clamping surfaces 25*a*, 26*a*, 26*b*, and 27*a* when the clamping plate portion 26 and the pressing plate portion 27 are crimped and thus the strands 14 are clamped by the clamping surfaces 25*a*, 26*a*, 26*b*, and 27*a*. In this way, it is possible to eliminate damage to the strands 14, favorably clamp the fiber conductor 11 without a defect such as disconnection, and increase connection reliability.

In this way, the fiber conductor 11 in which while a reduction in weight, tensile strength, and bendability are excellent, resistance to a shear force is low is not damaged, and the terminal 21 is not reduced in tensile strength by the fiber conductor 11, and the terminal 21 is reliably connected so as to obtain good mechanical and electrical performance.

First Example

Hereinafter, the present invention will be described in more detail by a first example. However, the present invention is not limited to the following examples.

<Tensile Strength Test>

The tensile strength of an electric wire with respect to a terminal was evaluated by a tensile test using an autograph. The terminal was connected to a fiber conductor of the electric wire and a load (N) until the electric wire is broken was measured by the autograph. The measurement was performed ten times for each of the terminals and the average value thereof was obtained and compared with a design target value (50(N)) of the tensile strength.

Example 1

An external coat of an electric wire provided with a fiber conductor was removed, thereby exposing the conductor. The fiber conductor was made by twisting strands composed of metal-plated fibers with electric conductivity imparted thereto in which Cu plating processing was performed on each polyarylate resin fiber and Sn plating processing was further performed thereon. The fiber conductor was connected to a terminal by the terminal connection structure of Modification Example 1 in the first embodiment shown in FIG. 5. In addition, the terminal was made of pure copper.

Comparative Example 1

The same electric wire and terminal as those in Example 1 were used, and the terminal was crimped and connected to the fiber conductor at a compression rate of 50% by crimping a barrel of a common crimp terminal.

Comparative Example 2

The same electric wire and terminal as those in Example 1 were used, and the terminal was crimped and connected to the fiber conductor at a compression rate of 75% by crimping a barrel of a common crimp terminal.

Comparative Example 3

The same electric wire and terminal as those in Example 1 were used, and the terminal was crimped and connected to the fiber conductor at a compression rate of 100% by crimping a barrel of a common crimp terminal.

The terminal connection structures of Example 1 and Comparative Examples 1 to 3 were used in the above tensile strength test and the measured values (the average values) of the tensile strength were obtained. The results are shown in FIG. 21.

Figure 21:
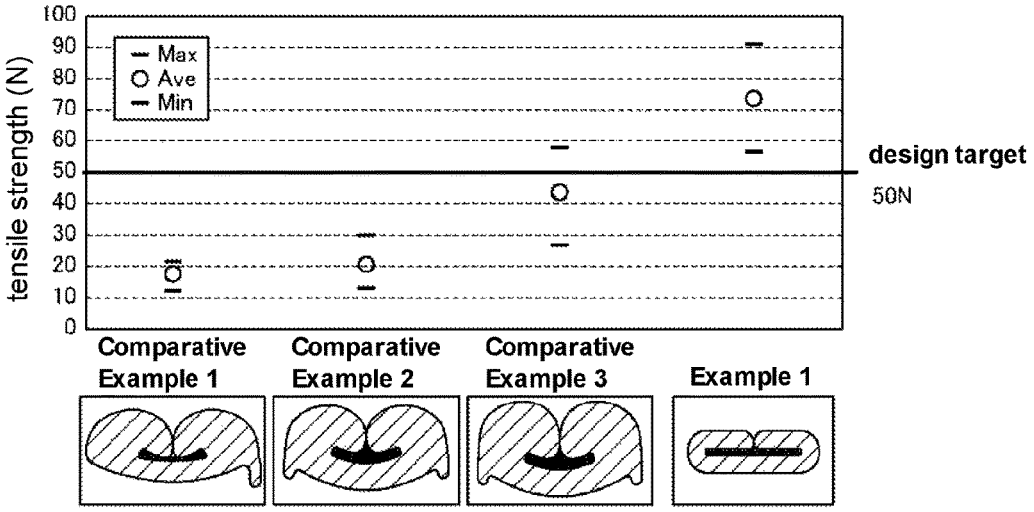
FIG. 21 is a diagram describing tensile test results.

As shown in FIG. 21, in Comparative Examples 1 and 2, the measured values of the tensile strength were below 50(N) which is the design target value. Further, in Comparative Example 3, the maximum value of the measured value of the tensile strength exceeded 50(N) which is the design target value. However, the average value was below 50(N) which is the design target value. In contrast, in Example 1, the minimum value of the measured value as well as the maximum value and the average value of the measured value of the tensile strength exceeded 50(N) which is the design target value.

From this, it was found that if the terminal connection structure according to the present invention is adopted, it is possible to connect the terminal to the electric wire having the fiber conductor while securing sufficient tensile strength.

Third Embodiment

Next, a third embodiment of the present invention will be described with reference to the drawings.

Figure 22:
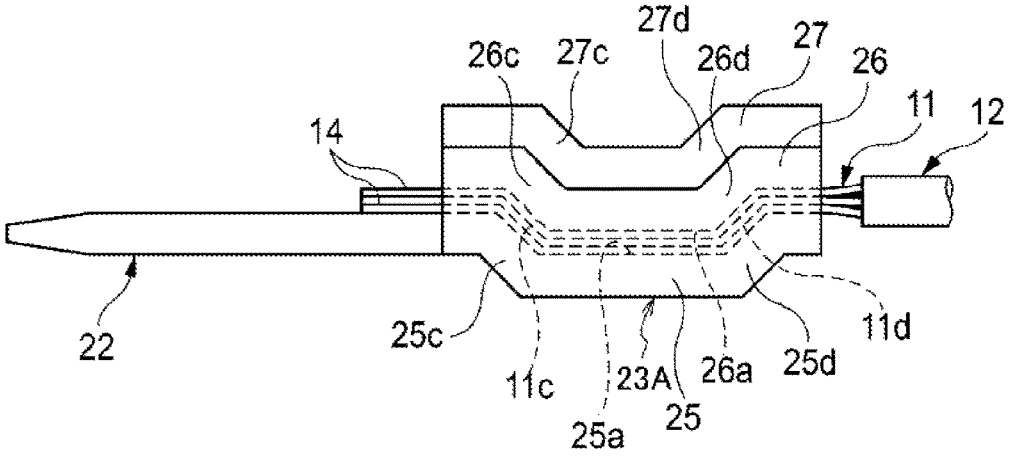
FIG. 22 is a side view of a connection place between an electric wire and a terminal, describing a terminal connection structure according to a third embodiment of the present invention.

FIG. 22 is a side view of a connection place between an electric wire and a terminal, describing a terminal connection structure according to the third embodiment. The terminal connection structure according to the third embodiment is schematically different from the terminal connection structure according to the first embodiment in that the flat plate portion (the clamping portion) 25, the clamping plate portion (the clamping portion) 26, and the pressing plate portion 27 are bent in the longitudinal direction of the electric wire 12. In other respects, the terminal connection structure according to the third embodiment is the same as the terminal connection structure according to the first embodiment, and therefore, the same configurations are denoted by the same reference numerals and there is a case where description is omitted.

As shown in FIG. 22, also in the terminal connection structure according to the third embodiment, the fiber conductor 11 is clamped between the flat plate portion 25 and the clamping plate portion 26. Further, the pressing plate portion 27 extends substantially parallel to the flat plate portion 25 with the fiber conductor 11 and the clamping plate portion 26 interposed therebetween, and the outer surface of the clamping plate portion 26 is pressed by the pressing plate portion 27.

In the terminal connection structure according to the third embodiment, the flat plate portion 25, the clamping plate portion 26, and the pressing plate portion 27 extend in the longitudinal direction (that is, a right-left direction in FIG. 22) of the electric wire 12 and are bent in the longitudinal direction, thereby respectively having bent portions 25*c* and 25*d*; 26*c* and 26*d*; and 27*c* and 27*d*, as shown in FIG. 22. Further, the fiber conductor 11 of the electric wire 12 clamped between the flat plate portion 25 and the clamping plate portion 26 is also bent in the longitudinal direction, thereby having bent portions 11*c* and 11*d*.

More specifically, the flat plate portion 25, the clamping plate portion 26, and the pressing plate portion 27 are bent downward once on the tab portion 22 side (the left side in FIG. 22) in the longitudinal direction of the electric wire 12, whereby the bent portions 25*c*, 26*c*, and 27*c* are formed. Further, the flat plate portion 25, the clamping plate portion 26, and the pressing plate portion 27 are bent upward again on the side (the right side in FIG. 22) opposite to the tab portion 22 side, thereby returning to the same height as the height of the tab portion 22, whereby the bent portions 25*d*, 26*d*, and 27*d* are formed. Further, the flat plate portion 25, the clamping plate portion 26, and the pressing plate portion 27 are bent so as to maintain a state where the clamping surfaces 25*a* and 26*a* and the surface of the pressing plate portion 27 are substantially parallel to each other. That is, more specifically, the flat plate portion 25 is bent downward once from a direction along the longitudinal direction of the electric wire 12 on the tab portion 22 side (the left side in FIG. 22) in the longitudinal direction of the electric wire 12 and is bent again so as to extend toward the direction along the longitudinal direction of the electric wire 12. In this way, the bent portion 25*c* is formed. In this manner, in this specification, a portion formed by being bent upward or downward once from an extending direction and bent again toward the extending direction is referred to as a bent portion.

Due to such a configuration, in the fiber conductor 11, the strands 14 are arranged in parallel so as to be substantially the same thickness in the width direction, along the clamping surfaces 25*a* and 26*a* which are the facing surfaces of the flat plate portion 25 and the clamping plate portion 26, between the flat plate portion 25 and the clamping plate portion 26. In this way, the clamping force by the flat plate portion 25 and the clamping plate portion 26 is substantially equally imparted to the respective strands 14. In this way, the terminal 21 is connected to the electric wire 12 in a state where the strands 14 of the fiber conductor 11 are clamped and held without deviation. Further, the pressing plate portion 27 extends substantially parallel to the flat plate portion 25 with the fiber conductor 11 and the clamping plate portion 26 interposed therebetween. In this way, the outer surface (that is, the surface on the side opposite to the clamping surface 26*a*) of the clamping plate portion 26 is pressed by the pressing plate portion 27, and thus a clamping state of the fiber conductor 11 between the flat plate portion 25 and the clamping plate portion 26 is maintained in a good state.

Further, the flat plate portion 25, the clamping plate portion 26, and the pressing plate portion 27 which are the clamping portions are bent in the longitudinal direction of the electric wire, thereby having at least one bent portion, and therefore, the rigidity of a crimping portion crimping the fiber conductor 11 is enhanced. For this reason, the rigidity of the crimping portion is prevented from being lower than the tensile strength of the fiber conductor 11, and thus it is possible to reliably secure the tensile strength.

In particular, in the terminal connection structure according to the third embodiment, the flat plate portion 25, the clamping plate portion 26, and the pressing plate portion 27 have two or more of the bent portions in the longitudinal direction of the electric wire 12, thereby being formed in a crank shape as a whole. That is, the flat plate portion 25, the clamping plate portion 26, and the pressing plate portion 27 are bent toward the lower side once on the tab portion 22 side, whereby the bent portions 25*c*, 26*c*, and 27*c* are formed, and the flat plate portion 25, the clamping plate portion 26, and the pressing plate portion 27 are bent toward the upper side which is the side opposite to the lower side, on the side opposite to the tab portion 22, whereby the bent portions 25*d*, 26*d*, and 27*d* are formed. In this manner, the rigidity of the crimping portion is further enhanced, and therefore, it is possible to more reliably secure the tensile strength.

Figure 23A:
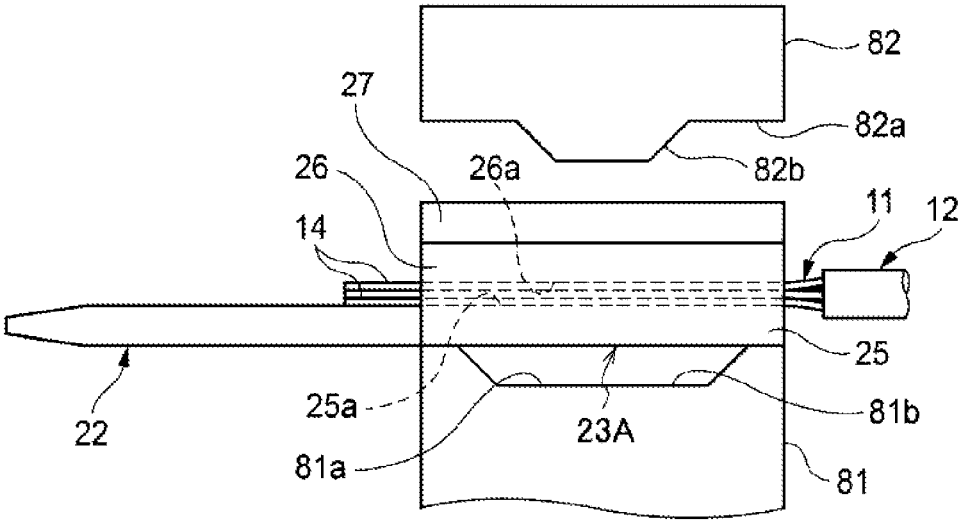
FIG. 23A is a longitudinal sectional view in a diagram describing a terminal connection process.
Figure 23B:
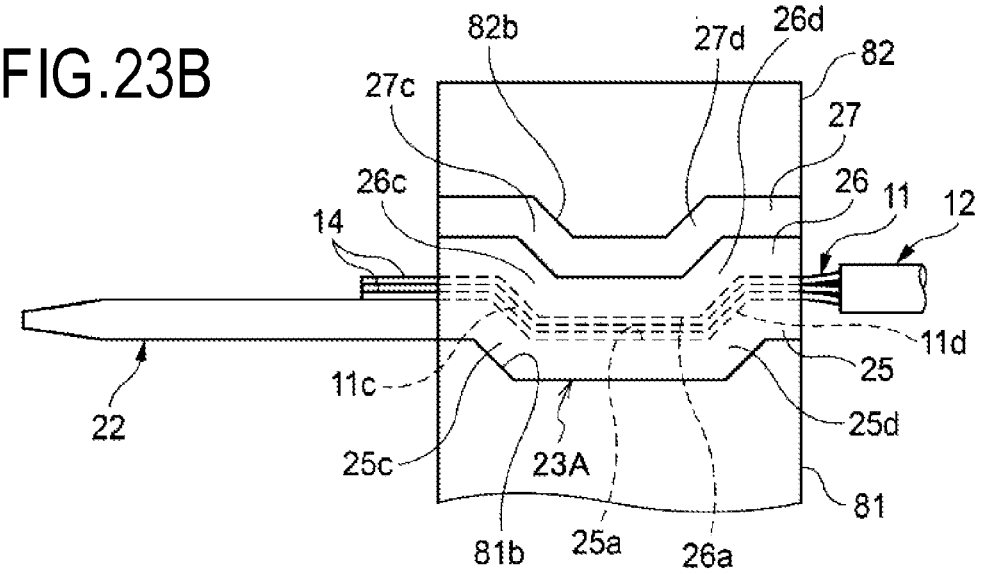
FIG. 23B is a longitudinal sectional view in a diagram describing the terminal connection process.

Next, a connection method of connecting the terminal 21 according to the third embodiment to the electric wire 12 will be described. FIG. 23A and FIG. 23B are longitudinal sectional views in a diagram describing a terminal connection process.

First, by using the lower die 31, the first upper die 32, and the second upper die 33, as described above, by the connection method shown in FIG. 4A to FIG. 4D, the fiber conductor 11 is disposed between the plurality of clamping portions (the flat plate portion 25 and the clamping plate portion 26) provided in the terminal 21, and the flat plate portion 25 and the clamping plate portion 26 are gradually brought close to each other, thereby being crimped such that the clamping surfaces 25*a* and 26*a* composed of the facing surfaces of the flat plate portion 25 and the clamping plate portion 26 are substantially parallel to each other, whereby the fiber conductor 11 is clamped in substantial the same thickness. In this way, a state is created where the fiber conductor 11 is clamped between the flat plate portion 25 and the clamping plate portion 26 and the outer surface of the clamping plate portion 26 is pressed by the pressing plate portion 27. At this point in time, the flat plate portion 25, the clamping plate portion 26, and the pressing plate portion 27 are flatly formed without having the bent portions in the longitudinal direction of the electric wire 12.

Thereafter, as shown in FIG. 23A and FIG. 23B, the flat plate portion 25, the clamping plate portion 26, and the pressing plate portion 27 are bent in the longitudinal direction of the electric wire 12 by using a lower die for crank bending 81 and an upper die for crank bending 82. More specifically, as shown in FIG. 23A, first, the fixing portion 23A of the terminal 21 is placed on an upper surface portion 81*a* of the lower die for crank bending 81 having a concave portion 81*b*. In this state, the upper die for crank bending 82 descends. The upper die for crank bending 82 has, at a lower surface portion 82*a*, a convex portion 82*b* at a position corresponding to the concave portion 81*b* of the lower die for crank bending 81. If the upper die for crank bending 82 descends, the lower surface portion 82*a* comes into contact with the upper surface of the pressing plate portion 27, whereby the flat plate portion 25, the clamping plate portion 26, and the pressing plate portion 27 are bent in the longitudinal direction of the electric wire 12 so as to maintain a state where the clamping surfaces 25*a* and 26*a* and the surface of the pressing plate portion 27 are substantially parallel to each other, thereby being deformed in the crank shape described above. With a different perspective, the concave portion 81*b* of the lower die for crank bending 81 and the convex portion 82*b* of the upper die for crank bending 82 have shapes corresponding to each other such that when the concave portion 81*b* and the convex portion 82*b* come close to each other, thereby pressing the flat plate portion 25, the clamping plate portion 26, and the pressing plate portion 27, the flat plate portion 25, the clamping plate portion 26, and the pressing plate portion 27 are deformed in a crank shape while maintaining a state where the clamping surfaces 25*a* and 26*a* and the surface of the pressing plate portion 27 are substantially parallel to each other.

According to such a terminal connection method, the flat plate portion 25, the clamping plate portion 26, and the pressing plate portion 27 are bent in the longitudinal direction of the electric wire 12, and therefore, it is possible to enhance the rigidity of the crimping portion crimping the fiber conductor 11. In this way, the rigidity of the crimping portion is prevented from being lower than the tensile strength of the fiber conductor 11, and thus it is possible to reliably secure the tensile strength.

In addition, in the terminal connection structure according to the third embodiment described above, a configuration has been described in which in the connection structure according to the first embodiment, the flat plate portion 25, the clamping plate portion 26, and the pressing plate portion 27 are bent in a crank shape in the longitudinal direction of the electric wire 12. However, it is acceptable if it is a configuration in which the flat plate portion 25, the clamping plate portion 26, and the pressing plate portion 27 are bent in the longitudinal direction of the electric wire 12 so as to maintain a state where the clamping surfaces 25*a* and 26*a* and the surface of the pressing plate portion 27 are substantially parallel to each other, and the connection structure according to the third embodiment may be applied to, for example, the modification examples of the first embodiment, or the connection structure according to the second embodiment and the modification example thereof. That is, in a case of being applied to the second embodiment, it is possible to make a configuration in which in the connection structure in which the fiber conductor 11 is clamped by the clamping surface 25*a* of the flat plate portion 25 and the clamping surface 26*a* of the clamping plate portion 26 and also clamped by the clamping surface 26*b* of the clamping plate portion 26 and the clamping surface 27*a* of the pressing plate portion 27, as shown in FIGS. 14 to 16, the flat plate portion 25, the clamping plate portion 26, and the pressing plate portion 27 are bent in the longitudinal direction of the electric wire 12 so as to maintain a state where the surfaces of the clamping surfaces 25*a*, 26*a*, and 27*a* are substantially parallel to each other.

Second Example

Hereinafter, the present invention will be described in more detail by a second example. However, the present invention is not limited to the following examples.

<Tensile Strength Test>

The tensile strength of an electric wire with respect to a terminal in a case where the size of a crimp height (C/H (mm), the height of a portion where a fiber conductor was fixed by the terminal) was changed was evaluated by a tensile test using an autograph. The terminal was connected to a fiber conductor of the electric wire and a load (N) until the electric wire is broken was measured by the autograph. The measurement was performed ten times for each of the terminals and the average value thereof was obtained and compared with a design target value (50(N)) of the tensile strength.

Example 2

An external coat of an electric wire provided with a fiber conductor was removed, thereby exposing the conductor. The fiber conductor was made by twisting strands composed of metal-plated fibers with electric conductivity imparted thereto in which Cu plating processing was performed on each polyarylate resin fiber and Sn plating processing was further performed thereon. The fiber conductor was connected to the terminal by the terminal connection structure according to the third embodiment shown in FIG. 22. In addition, the terminal was made of pure copper.

Comparative Example 4

The same electric wire and terminal as those in Example 1 were used, and the electric wire was connected to the terminal by the terminal connection structure according to the first embodiment shown in FIG. 1.

The terminal connection structures of Example 2 and Comparative Example 4 were used in the above tensile strength test and the measured values (the average values) of tensile strength were obtained. The results are shown in FIG. 24A and FIG. 24B.

Figure 24A:
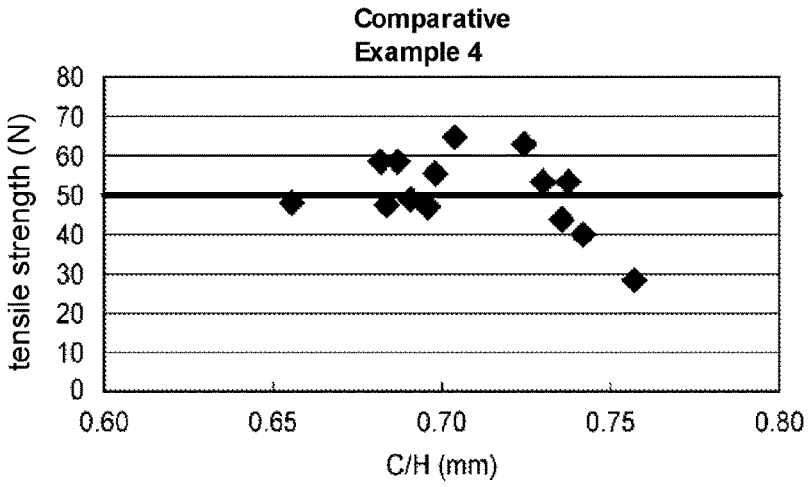
FIG. 24A is a diagram showing test results of Comparative Example 4 in a diagram describing tensile test results.
Figure 24B:
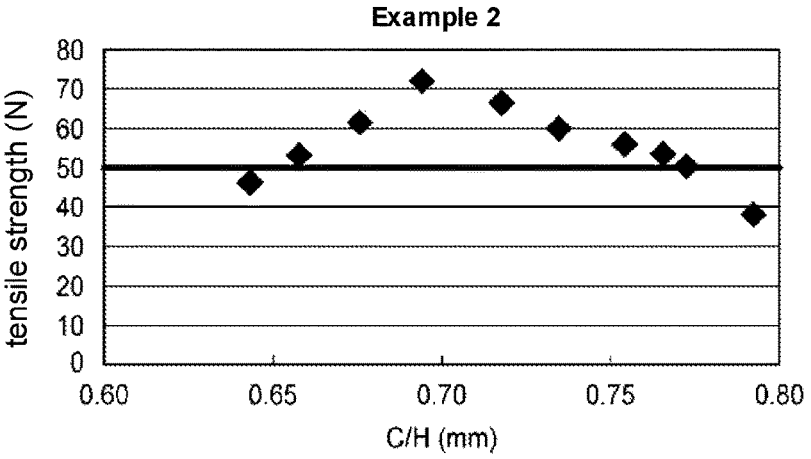
FIG. 24B is a diagram showing test results of Example 2 in a diagram describing tensile test results.

As shown in FIG. 24A, in Comparative Example 4, in many cases, the measured values of the tensile strength were below 50(N) which is the design target value, and targeted tensile strength was not stably obtained. In contrast, as shown in FIG. 24B, in Example 2, in a case where the value of C/H was in a predetermine range (for example, a range of 0.65 mm to 0.75 mm), the measured values of the tensile strength certainly exceeded the design target value, and targeted tensile strength was stably obtained.

From this, it was found that if the terminal connection structure according to the third embodiment is adopted, it is possible to connect the terminal to the electric wire having the fiber conductor while securing sufficient tensile strength.

In addition, the present invention is not limited to the embodiments described above, and modifications, improvements, or the like can be appropriately made. In addition, the quality of material, the shape, the dimensions, the number, the disposition place, or the like of each constituent element in the embodiments described above is arbitrary as long as it can achieve the present invention, and is not limited.

Here, the features of an embodiment of a fuse unit according to the present invention described above are collectively briefly listed in the following [1] to [5].

[1] A terminal connection structure in which a metal terminal (21) is connected to an electric wire (12) provided with a conductor (the fiber conductor 11) composed of a plurality of strands (14), wherein the terminal (21) has a plurality of clamping portions (the flat plate portion 25, the clamping plate portion 26, and the pressing plate portion 27) in which surfaces facing each other serve as clamping surfaces (25*a*, 26*a*, 26*b*, 27*a*), the plurality of clamping portions (the flat plate portion 25, the clamping plate portion 26, and the pressing plate portion 27) are crimped such that the respective clamping surfaces (25*a*, 26*a*, 26*b*, 27*a*) are substantially parallel to each other, thereby clamping the strands (14) configuring the conductor (the fiber conductor 11), by the clamping surfaces (25*a*, 26*a*, 26*b*, 27*a*), and each of the plurality of clamping portions (the flat plate portion 25, the clamping plate portion 26, and the pressing plate portion 27) has at least one bent portion (25*c*, 25*d*; 26*c*, 26*d*; 27*c*, 27*d*) in a longitudinal direction of the electric wire (12), and the clamping surfaces (25*a*, 26*a*, 26*b*, 27*a*) are held substantially parallel to each other.

[2] The terminal connection structure according to the above [1], wherein each of the plurality of clamping portions (the flat plate portion 25, the clamping plate portion 26, and the pressing plate portion 27) has two or more of the bent portions (25*c*, 25*d*; 26*c*, 26*d*; 27*c*, 27*d*) in the longitudinal direction of the electric wire (12) and is formed in a crank shape as a whole.

[3] The terminal connection structure according to the above [1] or [2], wherein the conductor includes a fiber conductor (11), and the fiber conductor (11) is composed of strands (14) which are metal-plated fibers with electric conductivity imparted thereto by performing metal plating on a surface of a fiber.

[4] The terminal connection structure according to the above [3], wherein the fiber is a polyarylate fiber.

[5] A terminal connection method of connecting a metal terminal (21) to an electric wire (12) provided with a conductor (the fiber conductor 11) composed of a plurality of strands (14), including:

a step of disposing the conductor (the fiber conductor 11) between a plurality of clamping portions (the flat plate portion 25, the clamping plate portion 26, and the pressing plate portion 27) provided in the terminal (21);

a step of gradually bringing the clamping portions (the flat plate portion 25, the clamping plate portion 26, and the pressing plate portion 27) close to each other, thereby crimping the clamping portions (the flat plate portion 25, the clamping plate portion 26, and the pressing plate portion 27) such that clamping surfaces (25*a*, 26*a*, 26*b*, 27*a*) composed of facing surfaces of the clamping portions (the flat plate portion 25, the clamping plate portion 26, and the pressing plate portion 27) are substantially parallel to each other, and thus clamping the conductor (the fiber conductor 11) in substantially the same thickness; and a step of bending the clamping portions (the flat plate portion 25, the clamping plate portion 26, and the pressing plate portion 27) in a longitudinal direction of the electric wire (12).

In addition, this application is based on a Japanese patent application (Japanese Patent Application No. 2013-077861) filed on Apr. 3, 2013, the contents of which are incorporated herein by reference.

INDUSTRIAL APPLICABILITY

According to the terminal connection structure and the terminal connection method according to the present invention, a terminal connection structure and a terminal connection method in which it is possible to connect a terminal to a conductor while maintaining high tensile strength and bendability can be provided.

REFERENCE SIGNS LIST

11: FIBER CONDUCTOR (CONDUCTOR)
11*c*, 11*d*: BENT PORTION
12: ELECTRIC WIRE
13: EXTERNAL COAT
14: STRAND
21: TERMINAL
23A TO 23H: FIXING PORTION
25: FLAT PLATE PORTION (CLAMPING PORTION)
26: CLAMPING PLATE PORTION (CLAMPING PORTION)
27: PRESSING PLATE PORTION (CLAMPING PORTION)
25*a*, 26*a*, 26*b*, 27*a*: CLAMPING SURFACE
25*c*, 25*d*, 26*c*, 26*d*, 27*c*, 27*d*: BENT PORTION
28: TAPERED SURFACE
29: ARCUATE SURFACE
31: LOWER DIE
32: FIRST UPPER DIE
33: SECOND UPPER DIE
41, 42, 43, 51, 52, 61, 62, 65, 66: CLAMPING PLATE PORTION (CLAMPING PORTION)
41*a*, 42*a*, 43*a*, 51*a*, 52*a*, 61*a*, 62*a*, 65*a*, 66*a*: CLAMPING SURFACE
71: CORE (CLAMPING PORTION)
72: CYLINDRICAL MATERIAL (CLAMPING PORTION)
71*a*, 72*a*: CLAMPING SURFACE
81: LOWER DIE FOR CRANK BENDING
81*a*: UPPER SURFACE PORTION
81*b*: CONCAVE PORTION
82: UPPER DIE FOR CRANK BENDING
82*a*: LOWER SURFACE PORTION
82*b*: CONVEX PORTION

What is claimed is:

1. A terminal connection structure comprising a metal terminal connected to an electric wire including a conductor having a plurality of strands, wherein the metal terminal has a plurality of clamping portions comprising surfaces facing each other and configured to serve as clamping surfaces, wherein the plurality of clamping portions are crimped over the plurality of strands of the conductor such that the clamping surfaces are substantially parallel to each other and the clamping surfaces clamp the plurality of strands of the conductor, wherein each of the plurality of clamping portions has at least two bent portion in a longitudinal direction of the electric wire, and the clamping surfaces are held substantially parallel to each other, and wherein the plurality of clamping portions include a clamping plate portion configured to clamp a first portion of the conductor onto a bottom clamping portion of the metal terminal, and a pressing plate portion configured to press onto a surface of the clamping plate portion and clamp a second portion of the conductor therebetween such that the first portion of the conductor is clamped between the clamping plate portion and the bottom clamping portion of the metal terminal, and the second portion of the conductor is folded over the clamping plate portion and clamped between the clamping plate portion and the pressing plate portion.

2. The terminal connection structure according to claim 1, wherein each of the plurality of clamping portions has more than two bent portions in the longitudinal direction of the electric wire and is formed in a crank shape.

3. The terminal connection structure according to claim 1, wherein the conductor includes a fiber conductor, and the plurality of strands of the conductor are metal-plated fibers with electric conductivity.

4. The terminal connection structure according to claim 2, wherein the conductor includes a fiber conductor, and the plurality of strands of the conductor are metal-plated fibers with electric conductivity imparted thereto by metal plating on a surface of the metal-plated fibers.

5. The terminal connection structure according to claim 3, wherein the metal-plated fibers comprise a polyarylate fiber.

6. The terminal connection structure according to claim 4, wherein the metal-plated fibers comprise a polyarylate fiber.

7. The terminal connection structure according to claim 1, wherein the plurality of clamping portions further includes a flat plate portion, and wherein the flat plate portion and the clamping plate portion are configured for clamping the conductor therebetween.

8. The terminal connection structure according to claim 7, wherein the flat plate portion, the clamping plate portion and the pressing plate portion are substantially parallel to each other when the conductor is clamped therein.

9. The terminal connection structure according to claim 1, wherein the plurality of clamping portions and the conductor are bent towards a same direction.

* * * * *